US008340358B2

(12) United States Patent
Cincotti et al.

(10) Patent No.: US 8,340,358 B2
(45) Date of Patent: Dec. 25, 2012

(54) VISUAL CAMOUFLAGE WITH THERMAL AND RADAR SUPPRESSION AND METHODS OF MAKING THE SAME

(75) Inventors: K. Dominic Cincotti, Fayetteville, NC (US); Trevor J. Kracker, Lumberton, NC (US)

(73) Assignee: Military Wraps Research and Development, Inc., Lumberton, NC (US)

( * ) Notice: Subject to any disclaimer, the term of this patent is extended or adjusted under 35 U.S.C. 154(b) by 668 days.

(21) Appl. No.: 12/386,986

(22) Filed: Apr. 24, 2009

(65) Prior Publication Data

US 2010/0112316 A1 May 6, 2010

Related U.S. Application Data

(63) Continuation-in-part of application No. 12/221,540, filed on Aug. 4, 2008.

(60) Provisional application No. 61/047,577, filed on Apr. 24, 2008.

(51) Int. Cl.
*G06K 9/00* (2006.01)
*H01Q 17/00* (2006.01)
*B32B 3/00* (2006.01)

(52) U.S. Cl. ..... 382/111; 342/3; 428/201

(58) Field of Classification Search ..... 382/111; 342/3, 39, 43, 59, 165; 427/156; 428/143, 428/201, 354, 919; 462/902; 396/322, 433; 977/786, 787, 833, 834
See application file for complete search history.

(56) References Cited

U.S. PATENT DOCUMENTS

| | | | | |
|---|---|---|---|---|
| 2,292,848 | A | 8/1942 | Robson | |
| 2,807,358 | A | 9/1957 | Blum | |
| 3,119,729 | A | 1/1964 | Birger | |
| 3,199,547 | A | 8/1965 | Knutson et al. | |
| 4,034,375 | A | 7/1977 | Wallin | |
| 4,064,305 | A | 12/1977 | Wallin | |
| 4,156,033 | A | 5/1979 | Bienz | |
| 4,287,243 | A | 9/1981 | Nielsen | |
| 4,560,595 | A | 12/1985 | Johansson | |
| 4,576,904 | A | 3/1986 | Anitole | |
| 4,615,921 | A * | 10/1986 | Johansson | 428/17 |

(Continued)

FOREIGN PATENT DOCUMENTS

WO WO 2008/091242 7/2008

OTHER PUBLICATIONS

"How to Disappear," The Economist Technology Quarterly, Sep. 6, 2008, pp. 21 and 24.

(Continued)

*Primary Examiner* — Abolfazl Tabatabai
(74) *Attorney, Agent, or Firm* — J. Bennett Mullinax, LLC

(57) ABSTRACT

A visual camouflage system that provides at least one of thermal or radar suppression is described. The system includes a vinyl layer having a camouflage pattern on a front surface of the vinyl layer. The camouflage pattern includes a site-specific camouflage pattern. A laminate layer is secured over the front surface of the vinyl layer coating the camouflage pattern to provide protection to the camouflage pattern and strengthen the vinyl layer. One or more nanomaterials are disposed on at least one of the vinyl layer, camouflage pattern, or the laminate to provide at least one of thermal or radar suppression.

46 Claims, 37 Drawing Sheets
(36 of 37 Drawing Sheet(s) Filed in Color)

U.S. PATENT DOCUMENTS

| | | | | |
|---|---|---|---|---|
| 4,767,649 | A | 8/1988 | Birch | |
| 5,013,375 | A | 5/1991 | Leonard | |
| 5,142,833 | A | 9/1992 | Svehaug | |
| 5,209,545 | A | 5/1993 | Slaugh | |
| 5,273,316 | A | 12/1993 | Infante | |
| 5,312,678 | A | 5/1994 | McCullough, Jr. et al. | |
| 5,348,789 | A | 9/1994 | Hellwig | |
| 5,381,149 | A | 1/1995 | Dougherty et al. | |
| 5,523,757 | A | 6/1996 | Resnick | |
| 5,549,938 | A | 8/1996 | Nesbitt | |
| 5,727,253 | A | 3/1998 | Wilkinson | |
| 5,734,495 | A | 3/1998 | Friedman | |
| 5,753,323 | A | 5/1998 | Andrus | |
| 5,786,785 | A | 7/1998 | Gindrup et al. | |
| 5,820,201 | A | 10/1998 | Jabalee | |
| 5,892,476 | A | 4/1999 | Gindrup et al. | |
| 5,924,131 | A | 7/1999 | Wilkinson | |
| 5,972,479 | A | 10/1999 | Lehman | |
| 6,003,749 | A | 12/1999 | Sabo | |
| 6,017,079 | A * | 1/2000 | Warner | 296/136.07 |
| 6,030,483 | A | 2/2000 | Wilson | |
| 6,127,007 | A | 10/2000 | Cox et al. | |
| 6,338,292 | B1 * | 1/2002 | Reynolds et al. | 89/36.02 |
| 6,342,290 | B1 | 1/2002 | Conk | |
| 6,682,879 | B2 * | 1/2004 | Conk | 430/396 |
| 6,692,030 | B1 | 2/2004 | Phillips et al. | |
| 6,710,841 | B2 * | 3/2004 | Tsang et al. | 349/158 |
| 6,712,058 | B2 * | 3/2004 | Porter | 124/86 |
| 6,805,957 | B1 | 10/2004 | Santos et al. | |
| 6,912,440 | B2 | 6/2005 | Tooley | |
| 6,924,792 | B1 | 8/2005 | Jessop | |
| 6,927,724 | B2 | 8/2005 | Snaper | |
| 6,953,511 | B2 | 10/2005 | Bowles, Jr. et al. | |
| 7,148,161 | B2 * | 12/2006 | Hellwig et al. | 442/131 |
| 7,215,275 | B2 | 5/2007 | Dumas | |
| 7,310,080 | B2 * | 12/2007 | Jessop | 345/89 |
| 7,345,616 | B2 | 3/2008 | Williams | |
| 7,378,124 | B2 | 5/2008 | Daniels | |
| 7,511,653 | B2 | 3/2009 | Yu et al. | |
| 8,077,071 | B2 | 12/2011 | Cincotti et al. | |
| 2004/0055068 | A1 | 3/2004 | Egnew | |
| 2004/0213982 | A1 | 10/2004 | Touzov | |
| 2005/0005339 | A1 | 1/2005 | Johnson | |
| 2005/0079330 | A1 | 4/2005 | Tanel | |
| 2005/0230963 | A1 | 10/2005 | McDowell et al. | |
| 2005/0276955 | A1 | 12/2005 | Tooley | |
| 2006/0071999 | A1 | 4/2006 | Lobley et al. | |
| 2006/0127570 | A1 | 6/2006 | Casburn et al. | |
| 2006/0154029 | A1 | 7/2006 | Antonini | |
| 2006/0222827 | A1 | 10/2006 | Marshall et al. | |
| 2007/0014916 | A1 | 1/2007 | Daniels | |
| 2007/0035435 | A1 | 2/2007 | Dumas | |
| 2007/0190368 | A1 | 8/2007 | Jung et al. | |
| 2007/0222658 | A1 | 9/2007 | Puscasu et al. | |
| 2008/0297878 | A1 | 12/2008 | Brown et al. | |
| 2009/0096703 | A1 | 4/2009 | Chase et al. | |
| 2009/0154777 | A1 | 6/2009 | Cincotti et al. | |
| 2009/0242597 | A1 | 10/2009 | Morgan et al. | |
| 2009/0252913 | A1 | 10/2009 | Cincotti et al. | |
| 2010/0012216 | A1 | 1/2010 | Salatino et al. | |
| 2010/0031423 | A1 | 2/2010 | Cincotti et al. | |
| 2010/0288116 | A1 | 11/2010 | Cincotti et al. | |

OTHER PUBLICATIONS

U.S. Appl. No. 12/436,654 to Cincotti et al. entitled "Assemblies and Systems for Simultaneous Multispectral Adaptive Camouflage, Concealment, and Deception" filed May 6, 2009.

Press Release—"Universal Display Showcases Its Eco-Friendly, 'Green' PHOLED Technology at Ecofocus/New York," Universal Display Corporation, Apr. 29, 2009.

Navy Press Release No. 597-08, Jul. 15, 2008.

McKee et al., "Future Combat Vehicle Protected by an Active Camouflage System," Military Technology (Miltech), Jul. 17, 2009.

Lockheed Martin Press Release—"Lockheed Martin and Rice Corporation Partner on Nanotech Research," http://www.lockheedmartin.com/cgi-bin/pfv.pl, Apr. 24, 2008.

KB Port Simulation Environments [online]. Jan. 25, 2008 [retrieved on Jan. 28, 2009]. www.kbport.com/products/pse-main.php?KeepThis=true&TB_iframe=true&width=805>; pp. 1-2; Figs. 1-2.

Kamouflage.net as of Aug. 16, 2010 found on website www.kamouflage.net/en_010400.php, copyright 2005 and 2008.

International Search Report and Written Opinion for PCT/US10/57455 dated Feb. 3, 2011.

International Search Report and Written Opinion for PCT/U509/39106 dated May 14, 2009.

International Preliminary Report on Patentability for PCT/US2009/039106 dated Oct. 14, 2010.

International Preliminary Report on Patentability for PCT/US2008/009374 dated Feb. 11, 2010.

Hooberman, B., "Everything You Ever Wanted to Know About Frequency-Selective Surface Filters but Were Afraid to Ask," http://calvin.phys.columbia.edu/group_web/filters/filter.pdf, May 2005.

Greenemeier, Larry: "Sticky Savior: U.S. Army Readies a New Blast-Protection Adhesive for Deployment," http://www.scientificamerican.com/article.cfm?id=army-polymer-adhesive, Dec. 18, 2008.

Gassler, John Jr.: "Military Wraps: The Next Generation in Combat Training Solutions," Special Operations Report, vol. 16, Sep. 15, 2008.

Florida, R., "Small Science with Big Promise—Nanotechnology Research at NJIT," NJIT Magazine, pp. 14-17, At least as early as Sep. 10, 2008.

Eom, Sang-Hyun, "White Phosporescent Organic Light-Emitting Devices with Dual Triple-Doped Emissive Layers," Appl. Phys. Lett., vol. 94, No. 15, 153303 (Apr. 16, 2009).

Eltron, "Advanced Nano-Phase Materials Promise to Revolutionize Solid State Power Generation, Peltier Heating/Cooling," Eltron Research and Development Tech Brief, 2009.

Depth Perception as of Oct. 24, 2007 found on the website http://en.wikipedia.org/wiki/Depth_perception.

Chwang, Anna B., "Thin Film Encapsulated Flexible Organic Electroluminescent Displays," Appl. Phys. Lett., vol. 83, 413, Jul. 21, 2003.

Cabot Corporation—"The Possibilities of Nanogel in Diverse Applications," http://www.cabot- corp.com/Aerogel/Coatings/What-IS-Aerogel/GN200811251355PM4239, at least as early as Nov. 25, 2008.

Bush, Steve—"Nextreme Patents Nano-Boost to Peltier Heat Pumps," Electronics Weekly.com, http://www.electronicsweekly.com/Articles/2008/04/01/43423/nextreme-patents-nano-boost-to-peltier-heat-pumps.htm, Mar. 28, 2008.

Boessenkool, A., "Lockheed Martin Looks to Nanotechnology," Lockheed martin, Sep. 12, 2008.

Bellamkonda, R. et al., "Bismuth Telluride Nano-Coolers for Magnetic Sensors," 213th Electrochemical Society Meeting, May 18-23, 2008.

International Search Report and Written Opinion for PCT/US08/09374 dated Apr. 16, 2009.

International Search Report and Written Opinion for PCT 11/35616 dated Jul. 25, 2011.

Notice of Allowance and Fee(s) Due dated Aug. 12, 2011 in U.S. Appl. No. 12/436,654.

Photograph of building in Northern Virginia with graphic artwork applied thereto. This artwork has allegedly been on the building since at least as early as 1993.

Overview-PHOLEDs-OLED technology www.universaldisplay.com, Aug. 22, 2008.

Non-Final Office Action for U.S. Appl. No. 13/323,571 dated May 2, 2012.

Non-Final Office Action for U.S. Appl. No. 12/286,871 dated Mar. 21, 2012.

Non-Final Office Action for U.S. Appl. No. 12/221,540 dated Mar. 28, 2012.

Homepage for Ad Graphics website, www.adgraphics.us, Dec. 22, 2008.

Digital Artform, History of Photo Mosaics, ww.digitalarchives.com/archives/2004/12/history_of_phot.html, Dec. 12, 2004.

Contact and FAQs webpages from Sign Farm website, www.signfarm.com, Dec. 16, 2008.
ARVN Tiger Stripe Pattern, www.kamouflage.net/camouflage/00187.php.
Ad Graphics, Inc. Advertisement, Sign Business Magazine, Nov. 1993.

* cited by examiner

VISUAL CAMOUFLAGE WITH THERMAL AND RADAR SUPPRESSION AND METHODS OF MAKING THE SAME

RELATED APPLICATIONS

The presently disclosed subject matter claims the benefit of U.S. Provisional Patent Application Ser. No. 61/047,577, filed Apr. 24, 2008; the disclosure of which is incorporated herein by reference in its entirety. Further, this application is a continuation-in-part patent application which claims the benefit of the filing date of U.S. patent application Ser. No. 12/221,540, filed Aug. 4, 2008, the disclosure of which is incorporated herein by reference in its entirety.

TECHNICAL FIELD

Systems and methods for visual camouflage that provide thermal and radar suppression are provided. In particular, systems and methods for the creation of a tactical vinyl graphic film (both adhesive and non-adhesive embodiments) whereby simultaneous visual camouflage, concealment and deception and suppression of the radar and thermal signatures are accomplished by the use of nanomaterials are provided.

BACKGROUND

Since World War II, tactical camouflage, concealment and deception designers have been forced to create solutions that addressed more than the visible spectrum of detection. This evolution is a result of increasingly sensitive sensor devices and technologies that have been developed over time. These sensor devices have included such divergent means as: enhanced optical range through advanced visual scopes, radar, night vision, and thermal imagery detection. Further, advances have led to technologies like forward looking infrared ("FLIR") imaging technology and shortwave infrared ("SWIR") sensing technologies that make invisible spectrum detection even better. Technologies and products are now merging these various sensor technologies together.

Today virtually every nation and many non-state military organizations have access to advanced tactical sensors for target acquisition (radar and thermal imagers) and intelligence gathering surveillance systems (ground and air reconnaissance). Precision-guided munitions exist that can be delivered by artillery, missiles, and aircraft and that can operate in the IR region of the electromagnetic spectrum. These capabilities are available through internal manufacturing or purchase on the world market. These advanced imaging sights and sensors allow enemies to acquire and engage targets through visual smoke, at night, and under adverse weather conditions.

To combat these new sensing and detection technologies, camouflage paint, paint additives, tarps, nets and foams have been developed for visual camouflage and thermal and radar signature suppression.

Paint and paint additives by themselves do not appear to be to provide a desired level of visual camouflage and thermal and radar signature suppression. For example, paint has proven inadequate for rendering highly detailed or complex camouflage patterns in use today, such as ACU and MARPAT, quickly and efficiently. Advanced paint additives and coatings seemed promising, but have unforeseen logistical issues. While it appears that chemical agent resistant coating ("CARC") paint is the ideal paint for camouflage and chemical protection, it is important to realize that it directly contributes to the problem. Several disadvantages are obvious when using CARC paint. CARC paint is considered environmentally hazardous, and its application requires Environmental Protection Agency ("EPA") approved safety equipment and facilities.

The EPA regulations restrict the use of CARC to one quart per site per day. Only approved facilities, such as depot-level maintenance facilities can dispense CARC in volume. This restriction on volume painting is attributed to the amount of volatile organic compounds released into the atmosphere when spraying. Further, CARC is expensive and has a limited shelf life. In fact, CARC is approximately four times more expensive than a low emission alkyd or polyurethane paint. Thus, from the bottle-necking that occurred in CARC paint facilities to EPA issues that make it problematic to repair without extensive costs to specialized equipment and facilities that are needed to the limited effectiveness against detection from the advanced technologies mentioned above, paints have proven to not be very effective.

Tarps and nets can provide separation between the vehicles being hidden and the point of observation of the detection systems used. Tarps and nets can suppress thermal signature as well as signals detected by radar. However, both tarps and nets can be heavy and cumbersome to use. They can thus interfere with mobility.

The use of foam appears to have promise regarding thermal and radar suppression. However, in the past, foam has been hard to effectively use in such camouflage, concealment or deception applications because the foam was not functional in terms of visual camouflage.

SUMMARY

It is an object of the presently disclosed subject matter to provide systems and methods for visual camouflage with thermal and/or radar suppression. For example, camouflage systems and methods that use a vinyl layer with a camouflage pattern printed thereon to provide visual camouflage, concealment and deception and include nanomaterials to provide suppression of the radar and/or thermal signatures are provided.

An object of the presently disclosed subject matter has been stated hereinabove, which is achieved in whole or in part by the presently disclosed subject matter. Other objects will become evident as the description proceeds when taken in connection with the accompanying drawings as best described hereinbelow.

BRIEF DESCRIPTION OF THE DRAWINGS

The patent or application file contains at least one drawing executed in color. Copies of this patent or application with color drawing(s) will be provided by the Patent and Trademark Office upon request and payment of necessary fee.

A full and enabling disclosure of the present subject matter including the best mode thereof to one of ordinary skill in the art is set forth more particularly in the remainder of the specification, including reference to the accompanying figures, in which.

DETAILED DESCRIPTION

Figure 1A:
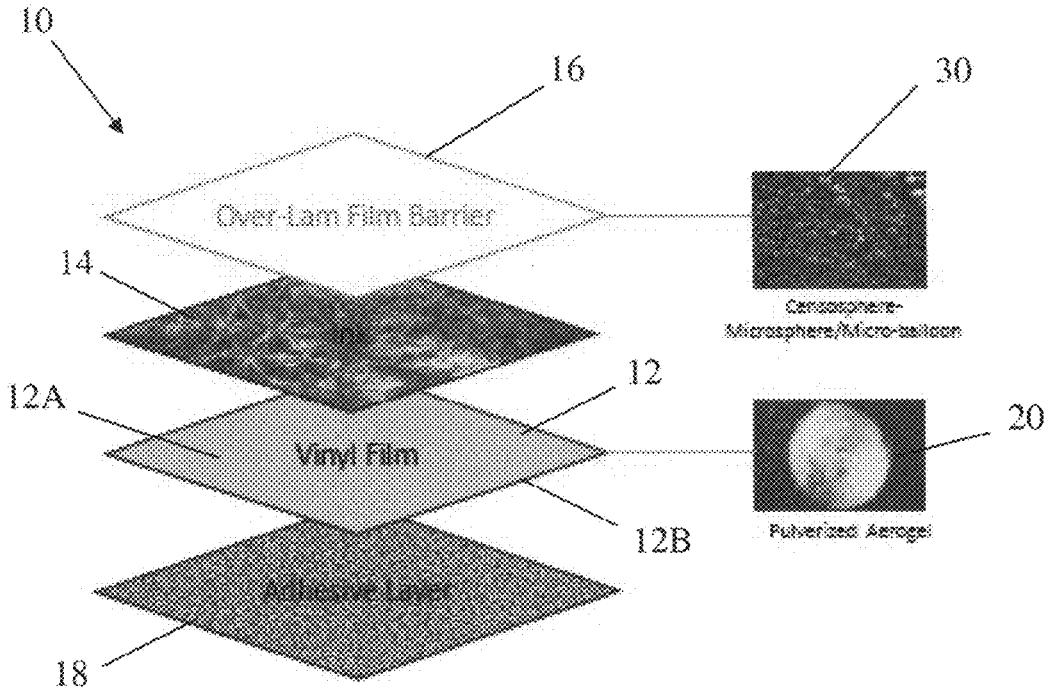
FIGS. 1A-1H illustrate schematic views of embodiments of a multi-layered visual camouflage system with thermal and radar suppression according to the present subject matter.

Reference will now be made in detail to the description of the present subject matter, one or more examples of which are shown in the figures. Each example is provided to explain the subject matter and not as a limitation. In fact, features illustrated or described as part of one embodiment can be used in another embodiment to yield still a further embodiment. It is intended that the present subject matter cover such modifications and variations.

"Site-specific" as used herein means a specific local terrain, nautical position, or airspace where a physical item will be located or operating, or the environmental characteristics which would be found in the intended operating environment of the physical item.

"Pattern" as used herein means any color and/or imagery, including, but not limited to camouflage patterns, repeating and non-repeating designs, deceptive designs, such as imagery that give the perception that a vehicle is an ambulance, taxi, police vehicle, or the like, and outward physical characteristics of a physical item such as rust, dents scratches, or the like, printed to a vinyl adhesive layer.

"Disruptive pattern" as used herein means a pattern of shapes that when configured on an image will cause visual confusion.

"Distortions," "distorting," and variations thereof as used herein means the changing of at least a portion of an image by manipulating the focal lengths within those portions of the image, adding to a first image a portion of the image or a portion of different image that has a different focal length than the first image, or adding shapes of color that change the appearance of the image. Focal lengths can include improper focal lengths that cause at least a portion of the image to appear to be out of focus.

"Focal lengths" as used herein means the distance at which an image will come into visual focus either by a human observer or through electronic, electromechanical and/or optical methods and devices. Focal lengths can include improper focal lengths that cause at least a portion of the image to appear to be out of focus.

"Image-editing program" as used herein means a computer program used to edit or change an image. Examples include Adobe PHOTOSHOP®, PAINT.NET® and PICASA®.

"Image" as used herein means the optical counterpart of an object or environment produced by graphical drawing by a person, a device (such as a computer) or a combination thereof. The optical counterpart of the object can also be produced by an optical device electromechanical device or electronic device. As used herein, "image" can be used to refer to a whole image, for example, a photographic image as taken by a photographic device, or a portion thereof.

"Physical item" as used herein can include, but is not limited to any and all types of vehicles (land, air and sea, and rail/manned & unmanned), aircraft, watercraft, structures, buildings, pipes and piping, equipment, weapons, hardware, and other items used for military or other purposes where camouflage can enhance its effective use or where the need for camouflage concealment or deception exists.

"Nanomaterial" as used herein means nano-scale technology, such as nanoparticles or clusters of nanoparticles. Nanoparticles behave as a whole unit in terms of its transport and properties. Nanomaterial can include but is not limited to aerogel in powder form, clusters of powdered aerogel, microspheres and clusters of microspheres.

Camouflage systems and methods that use a vinyl layer with a camouflage pattern printed thereon to provide visual camouflage, concealment and deception and include nanomaterials to provide suppression of radar and/or thermal signatures are described herein. Simultaneous visual camouflage, concealment and deception and suppression of the radar and thermal signature are accomplished by imagery and the use of nanomaterials. Such visual camouflage and thermal and radar suppression systems that incorporate a vinyl layer and nanomaterial into a light-weight application for vehicles (manned and unmanned, land, sea, and air), hardware, equipment and engineered structures can fulfill advanced countermeasure needs in response to the developing sensor technologies.

The visual camouflage system can provide at least one of thermal or radar suppression. The system can include a vinyl layer having a camouflage pattern on a front surface of the vinyl layer. The camouflage pattern can be a site-specific camouflage pattern. A laminate layer can be secured over the front surface of the vinyl layer with the laminate layer coating the camouflage pattern to provide protection to the camouflage pattern and strengthen the vinyl layer. One or more nanomaterials can be disposed on at least one of the vinyl layer, camouflage pattern, or the laminate to provide at least one of thermal or radar suppression.

The system with its nano-scale technology, ultra-light weight, and unique thin film (adhesive or non-adhesive) graphic vinyl based structure with visual camouflage thereon operates inter-dependently to provide simultaneous concealment, deception and thermal and radar suppression. The advanced visual camouflage can be accomplished through the use of, for example, high megapixel digital photography that is specific to the intended site, mission environment, or area of operation. It is printed in high detail and at a high resolution by suitably large format printing means, such as inkjet technology onto a vinyl thin-film. This tactical vinyl graphic film can then have an over-laminate protective barrier with a low-gloss finish laminated thereto.

Thermal and radar signature suppression counter-measures are embedded into or between layers of this ultra-thin, lightweight system in the form of nano-scale, air or gas-filled microspheres or micro-balloons that can also be metallic coated, such as cenospheres, and pulverized aerogels that consist of over 90% air in nano-scale pores that inhibit heat transfer with low density. These materials in combination with one another provide the mechanism for simultaneous visual camouflage and thermal and radar signature suppression.

Once the camouflage system is created, it can be applied to military and tactical vehicles (manned and unmanned land, sea or air), military hardware, equipment and engineered structures through the use of adhesives. The adhesive may be applied to the vinyl film before or after the camouflage image is added. Alternatively, the camouflage system can be of a non-adhesive nature.

The visual camouflage can be provided by camouflage patterns. The camouflage patterns and processes can use photo-digital processes to create the camouflage patterns. These processes can seek to disrupt the normal environment of the site-specific photographs to disrupt vision rather than attempting to create a camouflage pattern to match the photograph. Also, the various camouflage patterns described herein can create distinct camouflage patterns for different or multiple visual angles or perspectives of the same object in order to maximize stealth or concealment from each angle. Rather than attempting to create a camouflage pattern that is realistic or similar to what is displayed in a photograph, the camouflage patterns described herein can distort the image to disrupt vision thereby making the camouflage pattern more effective.

The nanomaterials used in the camouflage system can include aerogels and microspheres. Aerogels that can be used in the camouflage system are solid-state materials with very low densities. Aerogels describe a class of material based upon their structure, namely low density, open cell structures, large surface areas (often 900 $m^2/g$ or higher) and sub-nanometer scale pore sizes. Supercritical and subcritical fluid extraction technologies are commonly used to extract the fluid from the fragile cells of the material. A variety of different aerogel compositions are known and may be inorganic or organic. Inorganic aerogels are generally based upon metal alkoxides and can include but are not limited to materials such as silica, carbides, and alumina. Organic aerogels include carbon aerogels and polymeric aerogels such as polyimides.

Aerogels can be derived from a gel in which the liquid component of the gel has been replaced with gas. The result is an extremely low-density solid with several remarkable properties, most notably its effectiveness as a thermal insulator. Aerogels are good thermal insulators. As stated above, the aerogels can include silicon, carbon and metallic aerogels, such as alumina aerogels. Silica aerogels can be a good conductive insulator because silica is a poor conductor of heat. A metallic aerogel, on the other hand, may be a less effective insulator. Carbon aerogel is a good radiative insulator because carbon absorbs the infrared radiation that transfers heat at standard temperatures. Another good insulative aerogel is silica aerogel with carbon added to it.

When incorporated into a camouflage system described herein and the camouflage system is secured around a physical item, such insulative aerogels can provide good suppression of the thermal signature of the physical item. The aerogels can be pulverized into a powder form and embedded into a vinyl layer during manufacturing of the layer. The aerogels can contain particles ranging in size between about 1 to 10 nm, for instance about 2 to about 5 nm, that are generally fused into clusters. Alternatively, the aerogels can be included in the adhesives, inks, or laminate layer used on the vinyl layer. The inclusion of the aerogels, even in their pulverized or powder form, in the camouflage system can facilitate thermal suppression in the system and may improve radar suppression as well.

Similarly, microspheres can be included in the camouflage system. Microspheres are hollow microsphere particles that can be made from metal (e.g., gold), metal oxides (e.g., $Al_2O_3$, $TiO_2$, $ZrO_2$), silica, or the like. Microspheres can be fabricated with various diameters and wall thicknesses.

The microspheres can include glass microspheres and cenospheres. Hollow glass microspheres, sometimes termed microballoons, have diameters ranging from about 10 to about 300 micrometers. A cenosphere is a lightweight, inert, hollow sphere filled with inert air or gas, typically produced as a byproduct of coal combustion at thermal power plants. The color of cenospheres varies from gray to almost white and their density is about 0.4-0.8 $g/cm^3$, which gives them great buoyancy. Cenospheres are hard and rigid, light, waterproof, innoxious, and insulative.

When incorporated into a camouflage system described herein and the camouflage system is secured around a physical item, microspheres such as those described above, including glass, ceramics, and/or alumina silicate, can provide good suppression of the radar signature of the physical item. These microspheres can be embedded into the vinyl layer during manufacturing of the layer. Alternatively, the microspheres can be included in the adhesives, inks, or over-laminate used on the vinyl layer. The microspheres can contain particles ranging in size between about 10 to 300 micrometers, for example about 10 to about 20 micrometers. The microspheres can be generally fused into clusters. The microspheres separately and in clusters reflect waves in irregular or dispersed fashion to make a wave signature hard to detect. Thus, the inclusion of the microspheres in the camouflage system facilitates radar suppression and may improve thermal suppression in the system.

FIGS. 1A-1H, 2A-2B, and 3A-3E illustrate different embodiments of a visual camouflage system. A vinyl layer 12 can be provided. The vinyl layer 12 can have a front surface 12A and a back surface 12B. The back surface 12B can be on the surface opposite the front surface 12A. A camouflage pattern 14 can be printed on the front surface 12A of the vinyl layer 12. The camouflage pattern 14 can be a site-specific image as explained in more detail below. A first laminate layer 16 can be secured over the front surface 12A of the vinyl layer 12 with the laminate layer 16 coating the camouflage pattern 14 to provide protection to the camouflage pattern 14 and strengthen the vinyl layer 12. One or more nanomaterials 20, 30 can be disposed on at least one of the vinyl layer 12, camouflage pattern 14, or the laminate 16 to provide thermal and/or radar suppression.

Figure 1B:
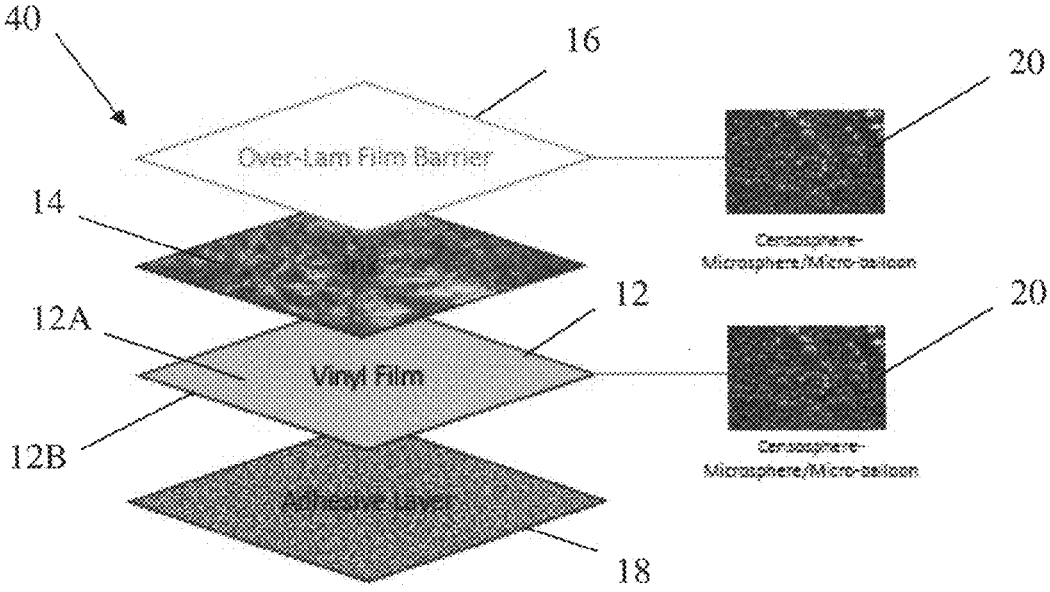
Figure 1C:
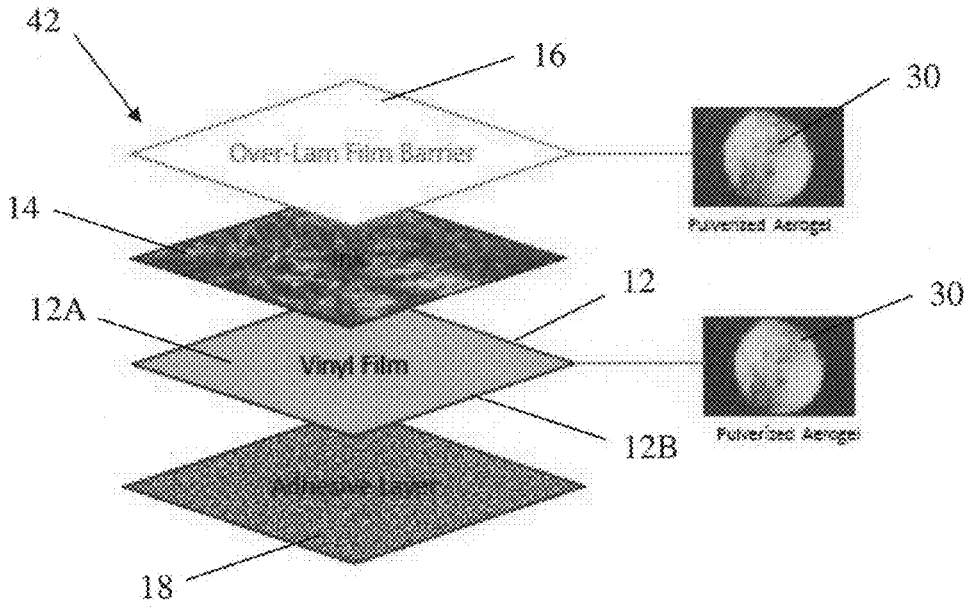
Figure 1D:
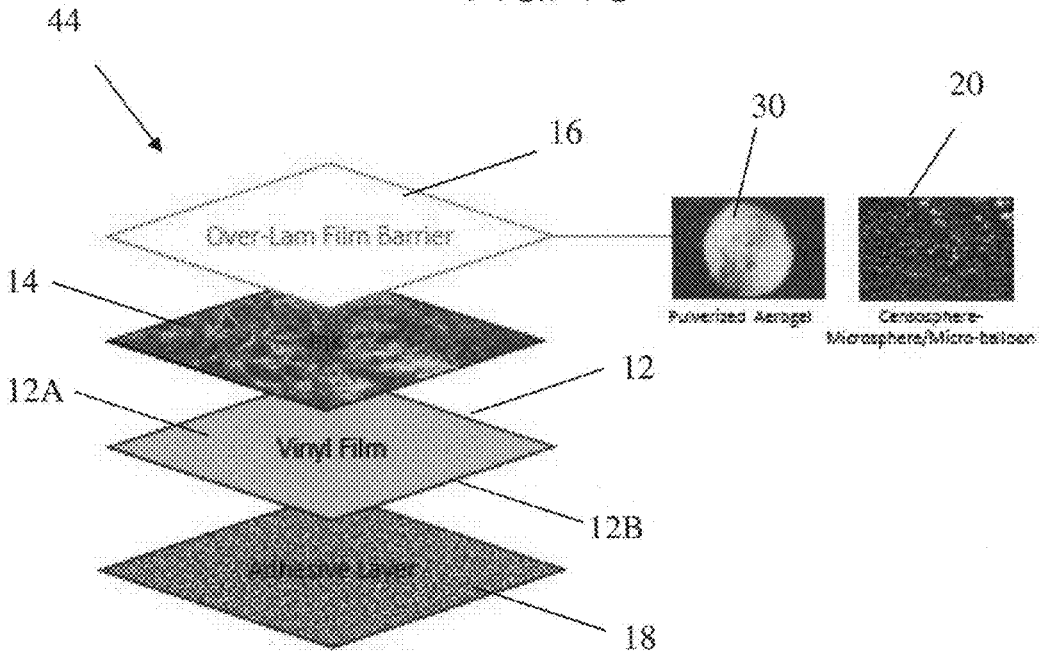
Figure 1E:
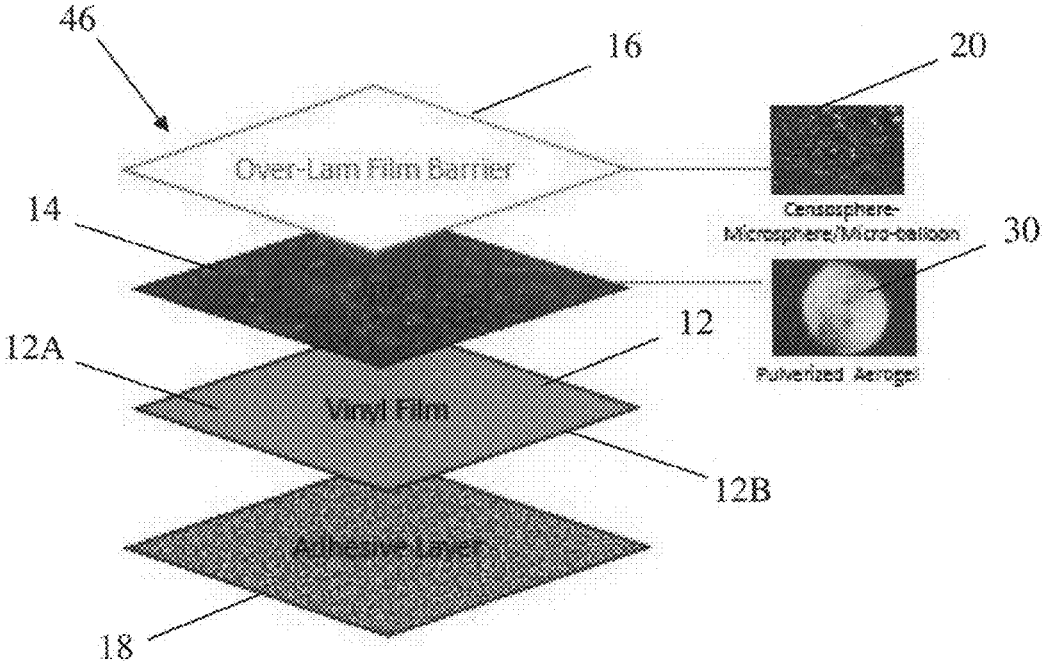
Figure 1F:
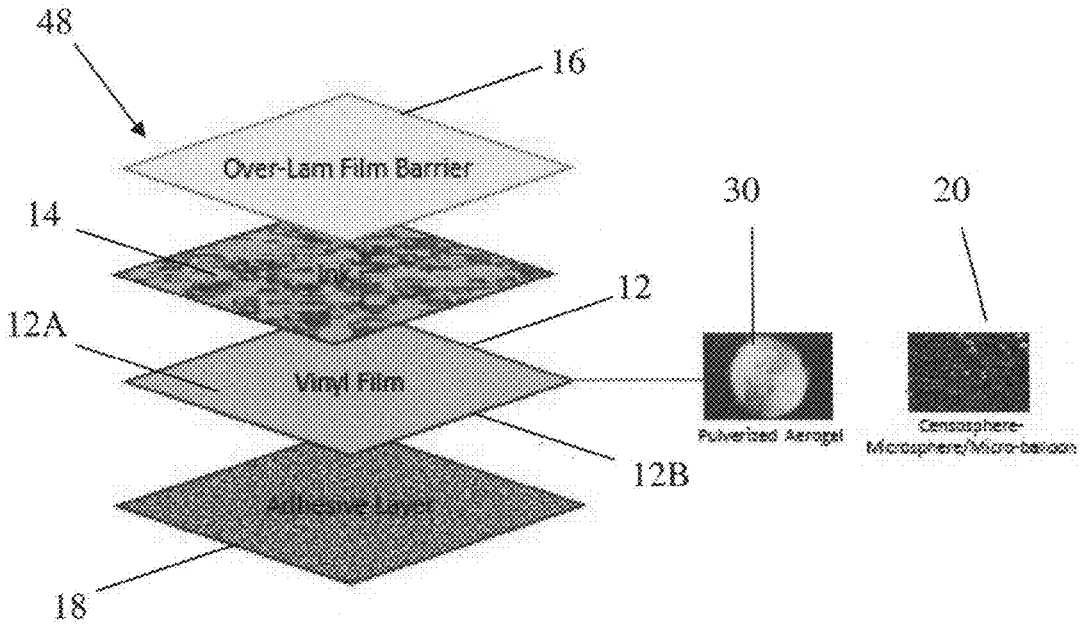
Figure 1G:
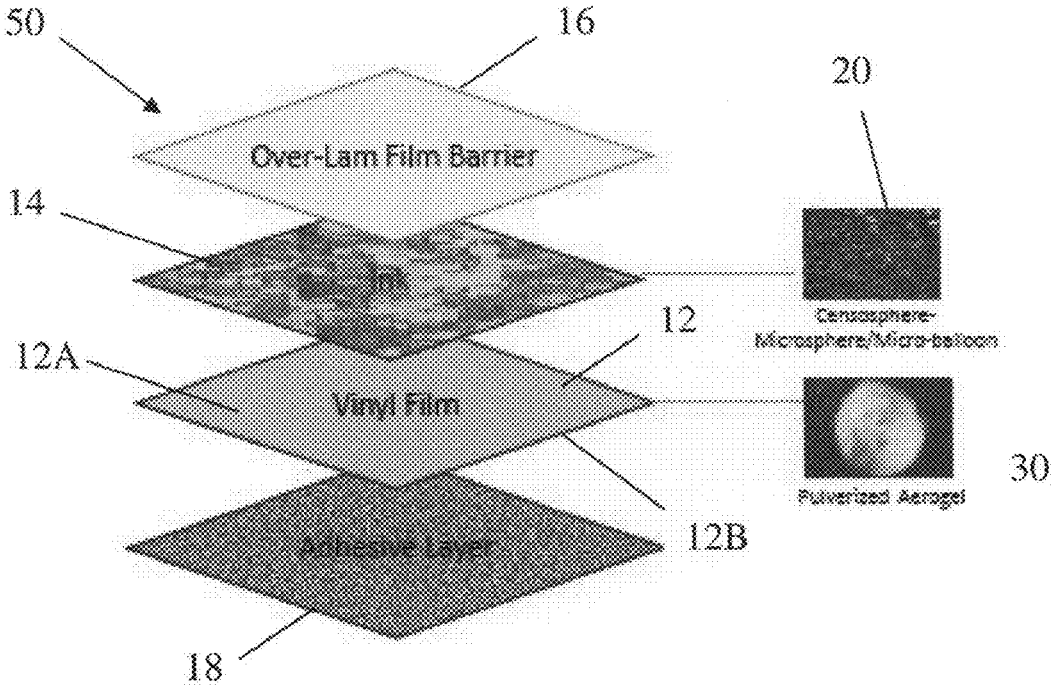
Figure 1H:
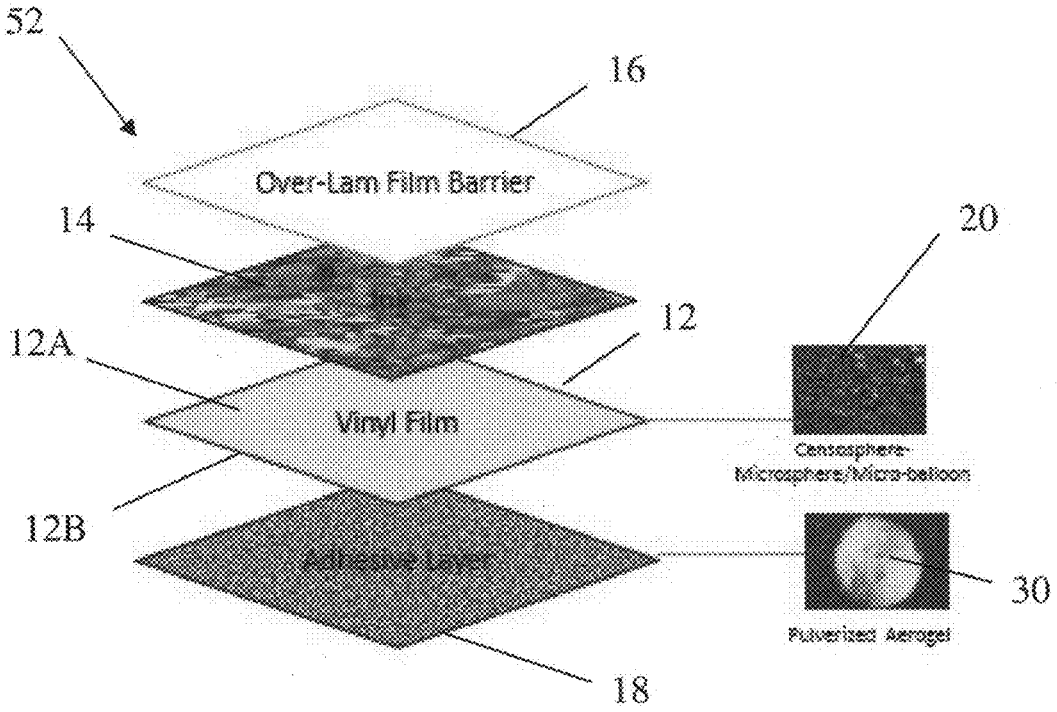
Figure 2A:
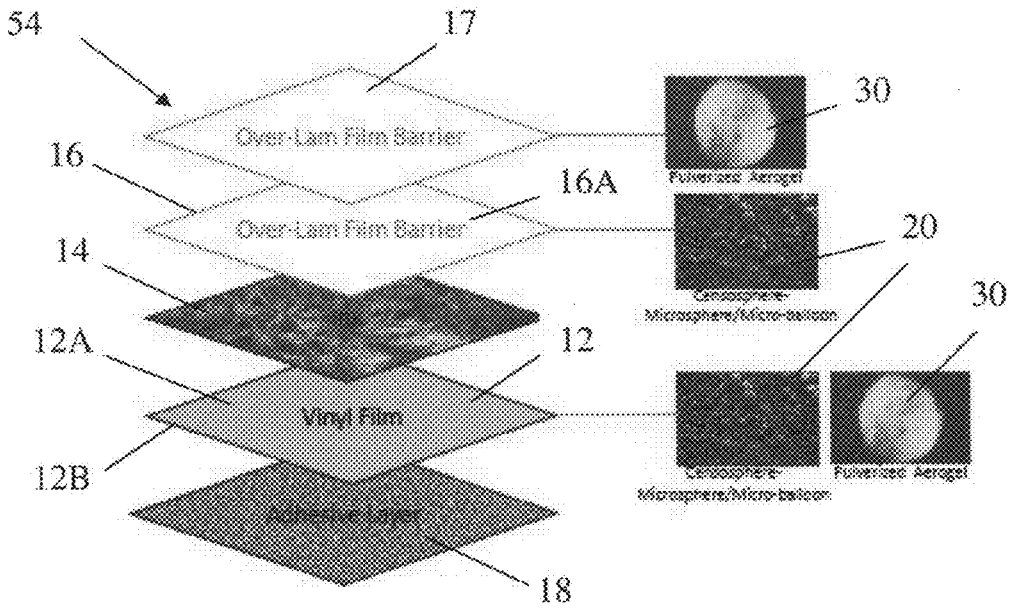
FIGS. 2A-2B illustrate schematic views of other embodiments of a multi-layered visual camouflage system with thermal and radar suppression according to the present subject matter.
Figure 2B:
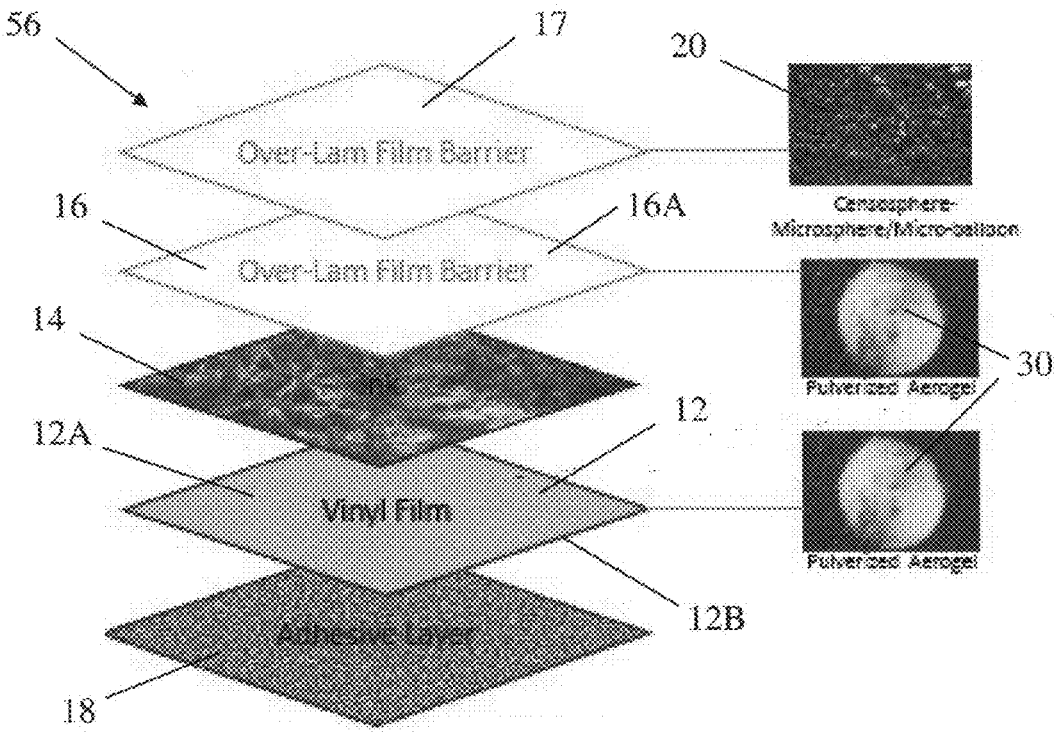
Figure 3A:
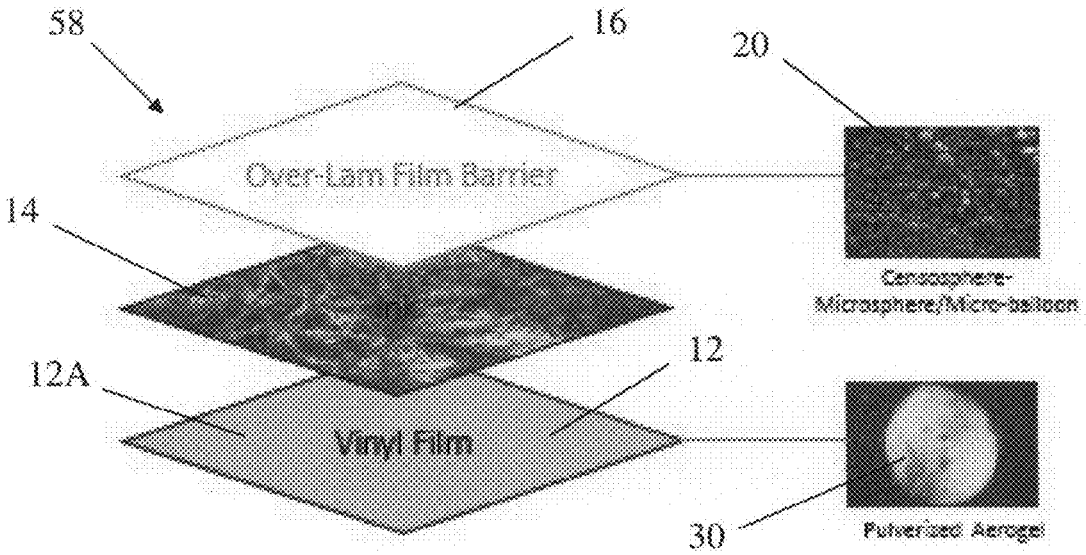
FIGS. 3A-3E illustrate schematic views of further embodiments of a multi-layered visual camouflage system with thermal and radar suppression according to the present subject matter.
Figure 3B:
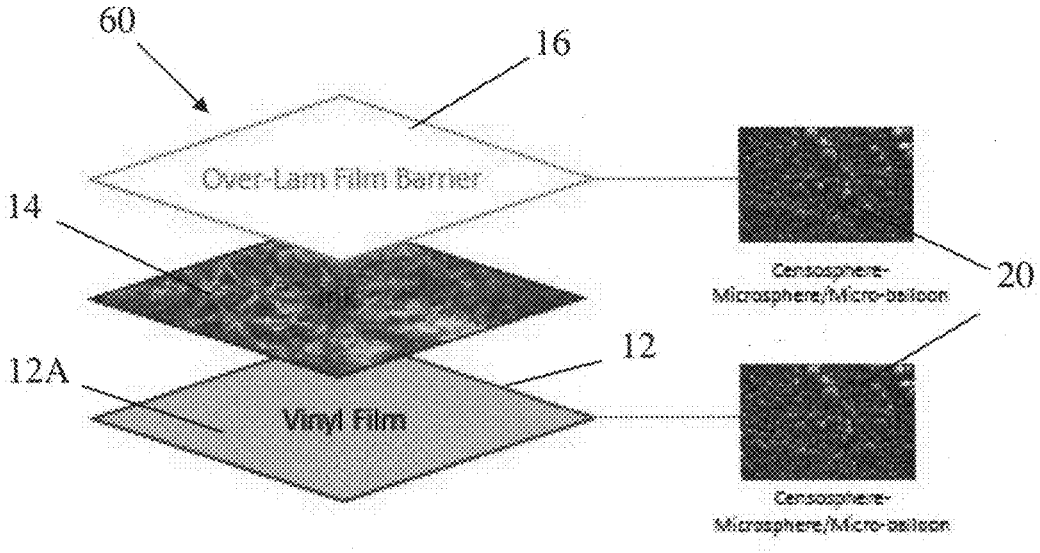
Figure 3C:
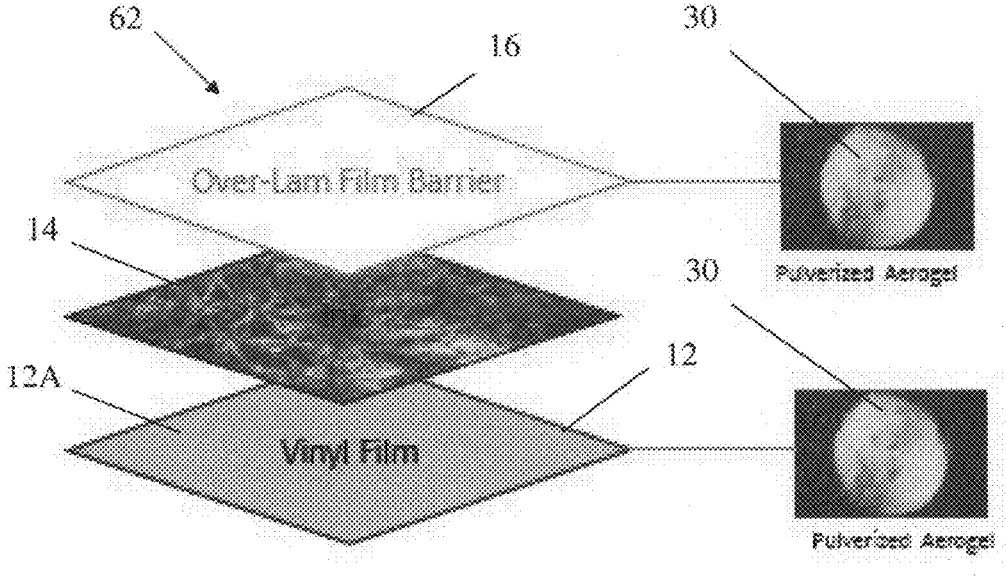
Figure 3D:
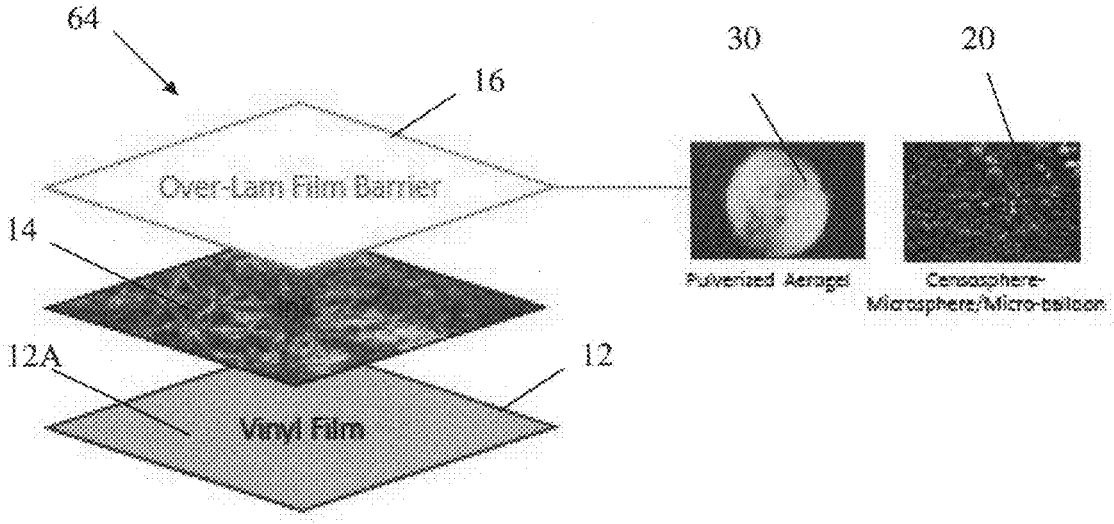
Figure 3E:
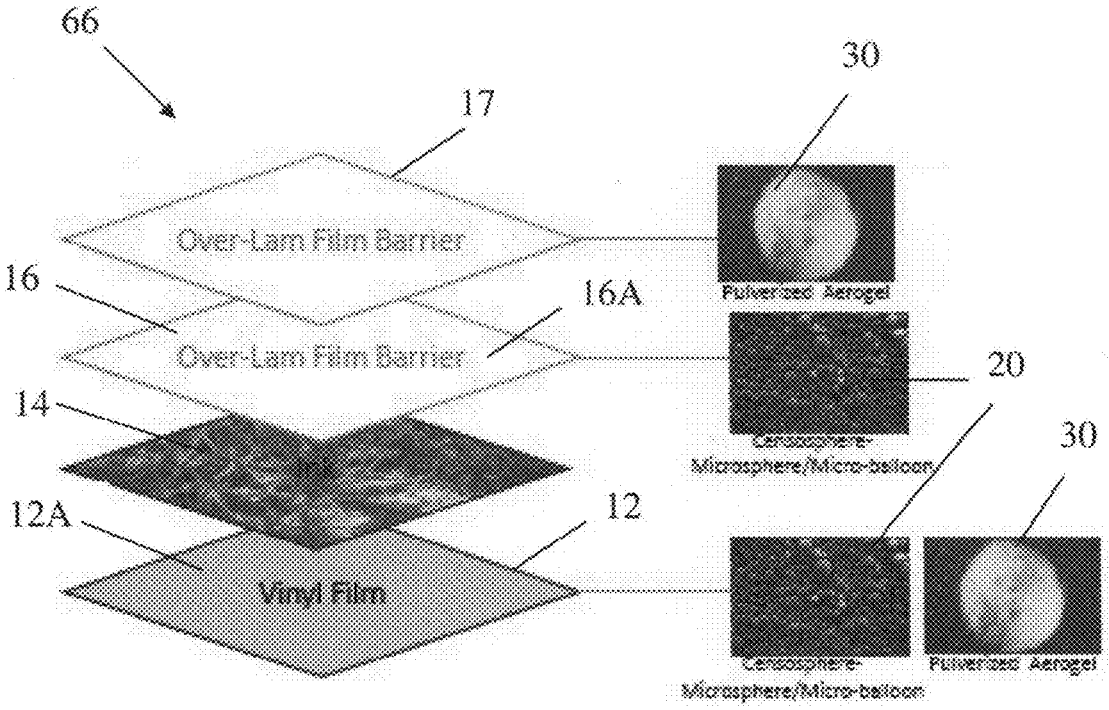

As shown in FIGS. 2A-2B and 3E, a second laminate layer 17 can be disposed on a surface 16A of the first laminate layer 16 opposite the surface on which the camouflage pattern 14 and vinyl layer 12 are secured. This front surface 16A of the first laminate layer 16 faces outward from the vinyl layer 12. Also, as shown in FIGS. 1A-1H and 2A-2B, an adhesive layer 18 can be applied on a surface 12B of the vinyl layer 12 opposite the front surface 12A on which the camouflage pattern 14 is disposed.

The nanomaterials 20, 30 can comprise a first nanomaterial or a second nanomaterial that provide thermal and/or radar suppression to the physical item to which the camouflage system is applied. For example, the nanomaterial 20 can comprise microspheres as described in detail above. Similarly, the nanomaterial 30 can comprise an aerogel as described in detail above. In some embodiments, it is preferably to have the microspheres in a layer above the aerogel such that the microspheres are closer to the outside environment instead of the physical item to which the camouflage system is attached.

As described in more detail below, one or both of the nanomaterials 20, 30 can be disposed on the vinyl layer 12. The deposition of the nanomaterials 20, 30 onto (for example, embedded in) a surface 12A, 12B of the vinyl layer can be performed by a sputtering deposition. Alternatively, one or both of the nanomaterials 20, 30 can be mixed into a vinyl material used to create the vinyl layer 12 before the vinyl layer 12 is formed. Similarly, one or both of the nanomaterials 20, 30 can be disposed on the laminate layer 16. The deposition of the nanomaterials 20, 30 onto (for example, embedded in) a surface of the laminate layer 16 can be performed by a sputtering deposition. Alternatively, one or both of the nanomaterials 20, 30 can be mixed into a laminate material used to create the laminate layer 16 before the laminate layer 16 is formed. Also, at least one of the nanomaterials 20, 30 can be disposed on the second laminate layer 17 as described above regarding the first laminate layer 16 when a second laminate layer 17 is used (See FIGS. 2A-2B and 3E).

Further, the camouflage pattern 14, which can comprises ink, can include one or both of the nanomaterials 20, 30. When including the nanomaterials 20, 30 in the ink, the ink can take longer to set. For example, one or both of the nanomaterials 20, 30 can be mixed into the ink before printing of the camouflage pattern 14 onto the vinyl layer 16. Similarly, the adhesive layer 18 can include one or both of the nanomaterials 20, 30. For example, one or both of the nanomaterials 20, 30 can be mixed into the adhesive used to create the adhesive layer 18 before application of the adhesive layer 18 onto the vinyl layer 12.

FIG. 1A illustrates an embodiment of a camouflage system 10 that can provide suppression for both the thermal signature and the radar signature of the physical item to which it is attached. The camouflage system 10 can have a vinyl layer 12 with a front surface 12A on which a site-specific camouflage pattern 14 is printed. A laminate layer 16 is secured overtop of the camouflage pattern 14 and the vinyl layer 12. An adhesive layer 18 is secured on the back surface 12B opposite the front surface 12A of the vinyl layer 12. A nanomaterial 30 in the form of an aerogel in powder form, i.e., a pulverized aerogel, can be included in the vinyl layer 12 to provide thermal insulation and suppression of the thermal signature of the physical item to which the camouflage system 10 is attached. A nanomaterial 20 in the form of microspheres can be included in the laminate layer 16 to provide suppression of the radar signature of the physical item to which the camouflage system 10 is attached.

Depending on the type of physical item that is being camouflaged and the environment in which it operates, the need for different types of signature suppression may vary. For example, for certain types of manned or unmanned aircraft, radar suppression may be more important that thermal suppression. FIG. 1B illustrates another embodiment of a camouflage system 40 that can provide more suppression for the radar signature of the physical item to which it is attached. The camouflage system 40 can have a vinyl layer 12 with a front surface 12A on which a site-specific camouflage pattern 14 is printed. A laminate layer 16 is secured overtop of the camouflage pattern 14 and the vinyl layer 12. An adhesive layer 18 is secured on the back surface 12B opposite the front surface 12A of the vinyl layer 12 for attachment of the camouflage system 40 to a physical item. In camouflage system 40, a nanomaterial 20 in the form of microspheres can be included in both the vinyl layer 12 and the laminate layer 16 to provide suppression of the radar signature of the physical item to which the camouflage system 40 is attached.

In another example, for certain types of manned or unmanned land vehicles, thermal suppression may be more important that radar suppression. FIG. 1C illustrates another embodiment of a camouflage system 42 that can provide more suppression for the thermal signature of the physical item to which it is attached. The camouflage system 42 can have a vinyl layer 12 with a front surface 12A on which a site-specific camouflage pattern 14 is printed. A laminate layer 16 is secured overtop of the camouflage pattern 14 and the vinyl layer 12. An adhesive layer 18 is secured on the back surface 12B opposite the front surface 12A of the vinyl layer 12 for attachment of the camouflage system 42 to a physical item. In camouflage system 42, a nanomaterial 30 in the form of an aerogel in powder form can be included in both the vinyl layer 12 and the laminate layer 16 to provide suppression of the thermal signature of the physical item to which the camouflage system 42 is attached.

FIG. 1D illustrates an embodiment of a camouflage system 44 that can provide suppression for both the thermal signature and the radar signature of the physical item to which it is attached. The camouflage system 44 can have a vinyl layer 12 with a front surface 12A on which a site-specific camouflage pattern 14 is printed. A laminate layer 16 is secured overtop of the camouflage pattern 14 and the vinyl layer 12. An adhesive layer 18 is secured on the back surface 12B opposite the front surface 12A of the vinyl layer 12 for attachment of the camouflage system 44 to a physical item. A nanomaterial 20 in the form of microspheres and a nanomaterial 30 in the form of an aerogel in powder form can be included in the laminate layer 16 to provide suppression of the radar signature and suppression of the thermal signature of the physical item to which the camouflage system 44 is attached.

FIG. 1E illustrates another embodiment of a camouflage system 46 that can provide suppression for both the thermal signature and the radar signature of the physical item to which it is attached. The camouflage system 46 can have a vinyl layer 12 with a front surface 12A on which a site-specific camouflage pattern 14 is printed. A laminate layer 16 is secured overtop of the camouflage pattern 14 and the vinyl layer 12. An adhesive layer 18 is secured on the back surface 12B opposite the front surface 12A of the vinyl layer 12 for attachment of the camouflage system 46 to a physical item. A nanomaterial 30 in the form of an aerogel in powder form can be included in the ink of the camouflage pattern 14 to provide suppression of the thermal signature of the physical item to which the camouflage system 46 is attached. A nanomaterial 20 in the form of microspheres can be included in the laminate layer 16 to provide suppression of the radar signature of the physical item to which the camouflage system 46 is attached.

FIG. 1F illustrates a further embodiment of a camouflage system 48 that can provide suppression for both the thermal signature and the radar signature of the physical item to which it is attached. The camouflage system 48 can have a vinyl layer 12 with a front surface 12A on which a site-specific camouflage pattern 14 is printed. A laminate layer 16 is secured overtop of the camouflage pattern 14 and the vinyl layer 12. An adhesive layer 18 is secured on the back surface 12B opposite the front surface 12A of the vinyl layer 12 for attachment of the camouflage system 48 to a physical item. A nanomaterial 20 in the form of microspheres and a nanomaterial 30 in the form of an aerogel in powder form can be included in the vinyl layer 12 to provide suppression of the radar signature and suppression of the thermal signature of the physical item to which the camouflage system 48 is attached.

FIG. 1G illustrates another embodiment of a camouflage system 50 that can provide suppression for both the thermal signature and the radar signature of the physical item to which it is attached. The camouflage system 50 can have a vinyl layer 12 with a front surface 12A on which a site-specific camouflage pattern 14 is printed. A laminate layer 16 is secured overtop of the camouflage pattern 14 and the vinyl layer 12. An adhesive layer 18 is secured on the back surface 12B opposite the front surface 12A of the vinyl layer 12 for attachment of the camouflage system 50 to a physical item. A nanomaterial 20 in the form of microspheres can be included in the ink of the camouflage pattern 14 to provide suppression of the radar signature of the physical item to which the camouflage system 50 is attached. A nanomaterial 30 in the form of an aerogel in powder form can be included in the vinyl layer 12 to provide suppression of the thermal signature of the physical item to which the camouflage system 50 is attached.

FIG. 1H illustrates an embodiment of a camouflage system 52 that can provide suppression for both the thermal signature and the radar signature of the physical item to which it is attached. The camouflage system 52 can have a vinyl layer 12 with a front surface 12A on which a site-specific camouflage pattern 14 is printed. A laminate layer 16 is secured overtop of the camouflage pattern 14 and the vinyl layer 12. An adhesive layer 18 is secured on the back surface 12B opposite the front surface 12A of the vinyl layer 12 for attachment of the camouflage system 52 to a physical item. A nanomaterial 20 in the form of microspheres can be included in the vinyl layer 12 to provide suppression of the radar signature of the physical item to which the camouflage system 52 is attached. A nanomaterial 30 in the form of an aerogel in powder form can be included in the adhesive layer 18 to provide suppression of the thermal signature of the physical item to which the camouflage system 52 is attached.

FIGS. 2A and 2B illustrate embodiments of camouflage systems 54 and 56 that are similar to some of the embodiments described above in that they can provide suppression for both the thermal signature and the radar signature of the physical item to which they are attached. The camouflage systems 54, 56 can have a vinyl layer 12 with a front surface 12A on which a site-specific camouflage pattern 14 is printed. A first laminate layer 16 is secured overtop of the camouflage pattern 14 and the vinyl layer 12. Further, a second laminate layer 17 can be secured on a front surface 16A of the first laminate layer 16. An adhesive layer 18 is secured on the back surface 12B opposite the front surface 12A of the vinyl layer 12 for attachment of the respective camouflage systems 54, 56 to a physical item.

In the camouflage system 54 in FIG. 2A, a nanomaterial 20 in the form of microspheres can be included in the first laminate layer 16 and the vinyl layer 12 to provide suppression of the radar signature of the physical item to which the camouflage system 54 is attached. Similarly, for camouflage system 54, a nanomaterial 30 in the form of an aerogel in powder form can be included in the second laminate layer 17 and the vinyl layer 12 to provide suppression of the thermal signature of the physical item to which the camouflage system 54 is attached.

In the camouflage system 56 in FIG. 2B, a nanomaterial 20 in the form of microspheres can be included in the second laminate layer 17 to provide suppression of the radar signature of the physical item to which the camouflage system 56 is attached. Similarly, for camouflage system 56, a nanomaterial 30 in the form of an aerogel in powder form can be included in the first laminate layer 16 and the vinyl layer 12 to provide thermal insulation and suppression of the thermal signature of the physical item to which the camouflage system 56 is attached.

FIGS. 3A-3B illustrate embodiments of camouflage systems 58, 60, 62, 64, and 66 that are similar to some of the embodiments illustrated in FIGS. 1A-1H except they do not include an adhesive layer. In FIG. 3A, camouflage system 58 provides both thermal and radar suppression. In camouflage system 58, a nanomaterial 30 in the form of an aerogel in powder form, i.e., a pulverized aerogel, can be included in the vinyl layer 12 to provide thermal insulation and thermal suppression. Also, a nanomaterial 20 in the form of microspheres can be included in the laminate layer 16 to provide radar suppression.

FIG. 3B illustrates another embodiment of a camouflage system 60 that can provide more radar suppression. In camouflage system 60, a nanomaterial 20 in the form of microspheres can be included in both the vinyl layer 12 and the laminate layer 16 to provide radar suppression. Conversely, FIG. 3C illustrates another embodiment of a camouflage system 62 that can provide more thermal suppression. In camouflage system 62, a nanomaterial 30 in the form of an aerogel in powder form can be included in both the vinyl layer 12 and the laminate layer 16 to provide thermal suppression.

In FIG. 3D, camouflage system 64 provides both thermal and radar suppression. In camouflage system 64, a nanomaterial 20 in the form of microspheres and a nanomaterial 30 in the form of an aerogel in powder form can be included in the laminate layer 16 to provide radar suppression and thermal suppression. In FIG. 3E, camouflage system 66 also provides both thermal and radar suppression. In camouflage system 66, a nanomaterial 20 in the form of microspheres can be included in the second laminate layer 17 and the vinyl layer 12 to provide radar suppression. Similarly, for camouflage system 66, a nanomaterial 30 in the form of an aerogel in powder form can be included in the first laminate layer 16 and the vinyl layer 12 to provide thermal suppression.

The processes for creating the layers of the camouflage system are described in more detail below. An example of a vinyl layer that can be used is a polyvinyl chloride ("PVC") film on which a camouflage pattern can be printed. For such a film, the conditions in the printing area are preferably controlled. For example, the room temperature and relative humidity can be between about 60° F. to about 90° F. and the relative humidity can be between about 50% to about 90% RH. For instance, the temperature and relative humidity can be about 73° F. (23° C.) and 50% RH when using as a substrate a 2.7 mil gloss white, polymeric stabilized, soft calendared PVC film designed for receiving digital ink jet printers. The ink used can be printing inks such as digital printing inks. Different inks can be used to ascertain different properties in the final product. The substrate used can be coated on one side with a permanent, opaque, acrylic, pressure sensitive adhesive with air egress technology and supplied with a 80# poly coated liner that is used as a release liner to protect the adhesive until time for application. Below is a list of physical properties of an example acrylic adhesive that can be applied to a substrate such as the PVC film described above.

TABLE 1

Properties of an Example Pressure Adhesive

| Physical Properties | Typical Values | Test Method (Federal Test Methods used) |
|---|---|---|
| Peel Adhesion, lb./in. (N/25 mm) 180 degrees on glass - 24 hr | about 3.2-about 4.6 (about 14-20) | FTM - 1 |
| Quick Tack on Glass lb./in. (N/25 mm) | about 3.4-about 4.8 (about 15-about 21) | FTM - 9 |
| Dimensional Stability, (%) 10" by 10" sample bonded to Aluminum | Maximum of about 0.5 | FTM - 14 |
| Normal Application Temperature and Temperature Ranges for Minimum Application | Above about 50° F. (about +10° C.) About −40° F. to about 194° F. (about −40° C. to about 90° C.) | |

Once the camouflage pattern is printed on the vinyl layer, the vinyl layer is laid on a drying table and left to "gas" or "dry" for a period of about 72 hours to ensure that the ink is dry. Once the layer has gone through the 72 hour period and depending on the end use of the layer, then it can be laminated in a lamination process to provide a laminate layer that overcoats the camouflage pattern and the vinyl layer. For example, for a layer of a PVC film to be used to cover a vehicle, the PVC film can be laminated. Laminating a layer like PVC film can add strength and protection to the printed image. For example, a laminate layer when bonded with the PVC film can provide protection to a vehicle on which it is applied (and any individuals inside) against chemical and biological agents and it can help protect the vehicle from corrosive agents as well. It can also be used to add gloss or a reflection control layer. In particular, the laminate layer can add non-shiny protection by being non-gloss or low gloss in nature.

The laminate layer used in such a lamination process can be a highly conformable cast film, such as a PVC film. Alternatively, it can be a polyester (PET) film that can range in thickness from about 0.5 mm to about 10 mm. For example, highly conformable cast film having thickness of about 1.5 mm can be used. A cast vinyl or PET laminate layer can have a built-in ultraviolet protection, be optically clear, and have a low gloss or no-gloss (flat) finish or matte. The laminate can include a permanent adhesive, such as an acrylic adhesive.

The vinyl layer with the camouflage pattern printed thereon and the laminate layer can be run through a lamination process where the adhesive side of the laminate faces the printed side of the substrate. The laminate layer and vinyl layer can then pass through pressurized heated or unheated rollers to secure the laminate layer to the vinyl layer. The laminate layer can be usable in temperatures from about 50° F. to about 225° F. Thus, the laminate layer can be applied to the vinyl layer in hot and cold applications. In the PVC film example, the vinyl layer can be left to cool after the material is laminated at about 120° F.

In another example, a 1.5-mil clear matte or a 1.5-mil clear gloss, which are highly conformable cast PVC films, can be chosen as the laminate layer. The over-laminate film is coated on one side with a clear permanent, acrylic pressure sensitive adhesive and supplied with a 1.2 mil polyester release liner. Upon application, the release liner can be removed. The vinyl layer with the camouflage pattern printed thereon and the laminate layer can be aligned so that the adhesive side of the laminate layer faces the printed side of the vinyl layer. The laminate layer and vinyl layer can then pass through pressurized rollers to secure the laminate layer to the vinyl layer. UV protection can incorporated into the laminate layer to help extend the life of the graphic by resisting color fade caused by ultraviolet light.

Suitable layers with the printed patterns described above that have a protective overcoating laminated thereto can provide excellent substrates to incorporate nanomaterials that can provide radar and/r thermal suppression as well. As mentioned above, nanomaterials such as appropriate aerogels and microspheres can be incorporated into different layer in different manners and at different stages described above. For example, each nanomaterial can be added to the laminate layers and vinyl layer on which the camouflage pattern is printed by a sputtering to randomly yet precisely dispose the nanomaterial on the respective layer. Alternatively, the nanomaterial(s) can be added to and mixed in with the material out of which the respective layers are made before the formation of the respective layers. Similarly, the nanomaterials can be added to the ink used to print the camouflage pattern on the vinyl layer or to the adhesive used in the adhesive layer by mixing the nanomaterials into either the ink or the adhesive before application on the vinyl layer. The amount of nanomaterial added to the camouflage system can vary. Also, the amount of nanomaterial added to the camouflage system can be customized to the application in which the camouflage system will be used or to the signature detection technology anticipated in the area of operation.

An installation process for securing the camouflage system to a physical item is described in more detail below. When creating the camouflage systems that can be secured to a physical item, a pattern can be created on an image-editing program for printing on the vinyl layer. Once the desired pattern is confirmed as described above, a proof can be printed at this stage to check and see if the appropriate color, clarity, and depth are still being achieved for the layers.

Next, using an image-editing program, the image of the pattern to be applied to each vinyl layer can be divided into the sections called panels hereinabove. After printing, these panels will fit together overlapping one another when placed on the physical item. No registry lines are necessary. The overlapping of the panels improves seal, adhesion, and installation procedures. The sizes of the panels can depend on the size of the physical item to be covered and are only constrained by the cost effectiveness of the selected size, manageability of the installation process, and the printer capabilities. For example, the panels can range from a few square inches to lengths and widths of 100 inches or more.

Figure 4:
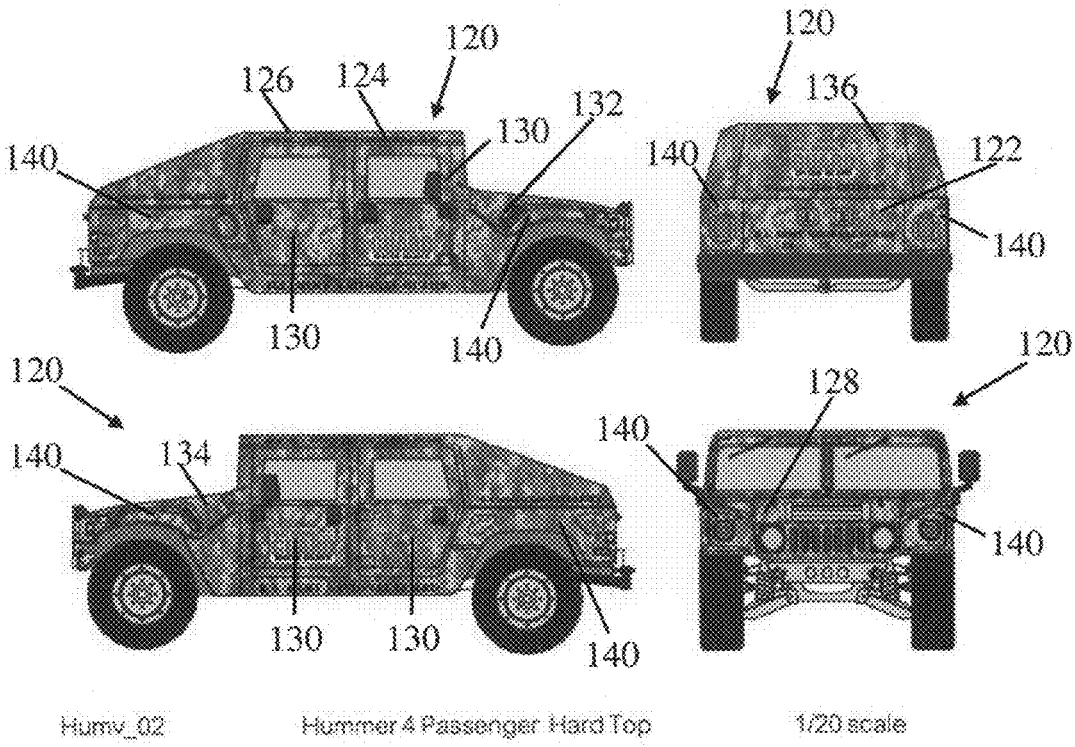
FIG. 4 illustrates an embodiment of a physical item having an embodiment of a camouflage pattern or arrangement attached thereto according to the present subject matter.

The panel process and application is explained using a specific example of a typical U.S. Military 1025 HUMVEE™ 120 shown in FIG. 4. However, the same general process can be used with other physical items. The design is divided into the following corresponding panels which in FIG. 4 have been printed to a substrate such as a polyvinyl chloride (PVC) film and already applied to the HUMVEE™ 120: a tailgate panel 122, a first roof panel 124 (partially shown), a second roof panel 126 (partially shown), a boot panel 128, door panels 130, a center hood panel (not shown), left and right hood panels 132, 134, (partially shown), a back panel 136, and fender/frame panels 140.

If the three items of color, clarity, and depth are achieved, then the panel sections are saved and sent to the printer to begin the "rip" process of transferring the panel images to the printer and the printer's software. Before the rip process is to begin, another proof can be printed to make sure that nothing has moved or been dropped from the file. Once this proof is checked, a test print process of printing an actual panel or a portion of an actual panel on a layer can be done to make sure the colors match between the pattern on the screen of the computer and the pattern printed on the panel of the layer.

If there is a match, the production operator then begins to print the necessary panels for the HUMVEE™ 120. In the case of the HUMVEE™ 120, there are 15 panels that are printed in our process. Each panel runs different in size. The sizes provided below are provided as only examples and the number and size of the panels may vary based on the criteria outlined above. In particular, the sizes of the panels can depend on the size of the physical item to be covered and are only constrained by the cost effectiveness of the selected size, manageability of the installation process, and the printer capabilities. The selected sizes can assist with the installation process. The selected sizes can help with manageability and control of the product for the installation crews during the installation process. The selected sizes can promote versatility as some of the installations are done outdoors and some are done indoors. Wind and the elements are a factor in the installation process.

For the example HUMVEE™ 120, 15 panels can be printed in the following sizes:

1. 1-21"×87" tailgate panel;
2. 1-52"×74" first roof panel;
3. 1-52"×74" second roof panel;
4. 1-60"×53" boot panel;
5. 4-95"×53" door panels;
6. 1-54"×70" center hood panel;
7. 1-36"×70" left hood panel;
8. 1-36"×70" right hood panel;
9. 2-53×80 back panel;
10. 1-53"×80" first fender/frame panel; and
11. 1-53"×80" second fender/frame panel.

For an embodiment of a layer with the pattern thereon that is to be attached to a physical item, an installation process can be used to facilitate proper attachment to the wherein the substrate is the PVC film example given above, installers now prepare the vehicle for the installation process. The installation process can be done in various ways. An example process is provided below. The example installation process contains six general steps. The steps of the example installation process are provided below.

Example of Installation Method

Step 1. Check the Material

1. Look at the template; it should be confirmed that the overlapping panels to be installed are the correct panels for the physical item selected for installation.
2. Confirm that all overlapping panels are available.
3. Do an initial "tape up" to ensure proper fit & alignment placing emphasis on not losing any text or design features.

Step 2. Remove Obstacles

1. Determine if accessories from the physical item having a camouflage system placed therein need to be removed to facilitate attachment of the overlapping panels to the physical item. Examples of accessories for a vehicle can include the following:

A. Mirrors;
B. Antennas;
C. Door handles;
D. Rubber window tracks;
E. Lamp Assemblies;
F. Emblems (ask customer, some may not want off); and
G. Any old graphics (pin stripping & vinyl decals, etc).

Step 3. Clean Vehicle Thoroughly

1. Use a good wax & grease remover (wet rag & dry rag) and follow up with alcohol to thoroughly clean the physical item.
2. Emphasis should be placed on areas of the physical item that tend to be exposed to or collect dirt. For example, on a vehicle, all doors, hood, trunk edges, fender wells, moldings door handles, or the like should be emphasized.

Step 4. Install Panels

1. Do an exact tape-up.
2. Mark line up points on physical items taking into account an overlapping of the panels at sections where panels border each other. Depending on the physical item being covered, the overlapping can vary.
3. It is recommended that the installation start at the rear of the physical item and work to the front. However, the installation can start at the front of the physical item and work to the rear. As stated above, the panels can overlap. The amount of overlap depends on factors that can include, for example, intended use, environment of use, the type and size of the physical item, and the type of substrate, laminate or ink used. The overlap can range from about 0.75 inches to about 3 feet depending on the application and the factors listed above. In some instances, the overlap can be between about 1.25 inches and about 4.0 inches.
4. At border sections where panels overlap, the panels can be bonded using an open flame. For example, a snap torch can be used to heat the area of overlap to more effectively heat the laminate and seal and adhere the overlapped panels together.
5. During and after an installation of a panel, the panel may need to be cut. When cutting, be sure not to cut on a body or any plastic parts of the physical item as it can leave a permanent mark.
6. Heat in all edges & relief cuts to smooth the edges.
7. Look over the installation carefully.
8. Check for lifting in any convex or concave curves and reheat, if necessary.

Step 5. Install Window Perforation (if Needed)

1. Some physical items may include glass that can be covered with a perforated material commonly used on glass in the industry having the pattern printed thereon. If glass is to be covered, the glass should be cleaned with glass cleaner. Preferably, no Ammonia is used. This cleaning can be followed with a wipe down of the glass of Isopropyl Alcohol.
2. Cut the Perforated material 1/16 of an inch from the edge to ensure it does not get caught in the window rubbers.
3. Run rivet brush around edges to ensure adhesion.
4. When cutting, make straight cuts.

Step 6. Reinstall Removed Items (if Necessary)

1. Once all the layers are installed, any removed items can be reattached. Be careful not to damage the installed panels.
2. Analyze the installed panels looking for any areas that may fail. Examples of places to inspect on a vehicle include: fender wells, all edges, door handles, or the like.

Figure 27:
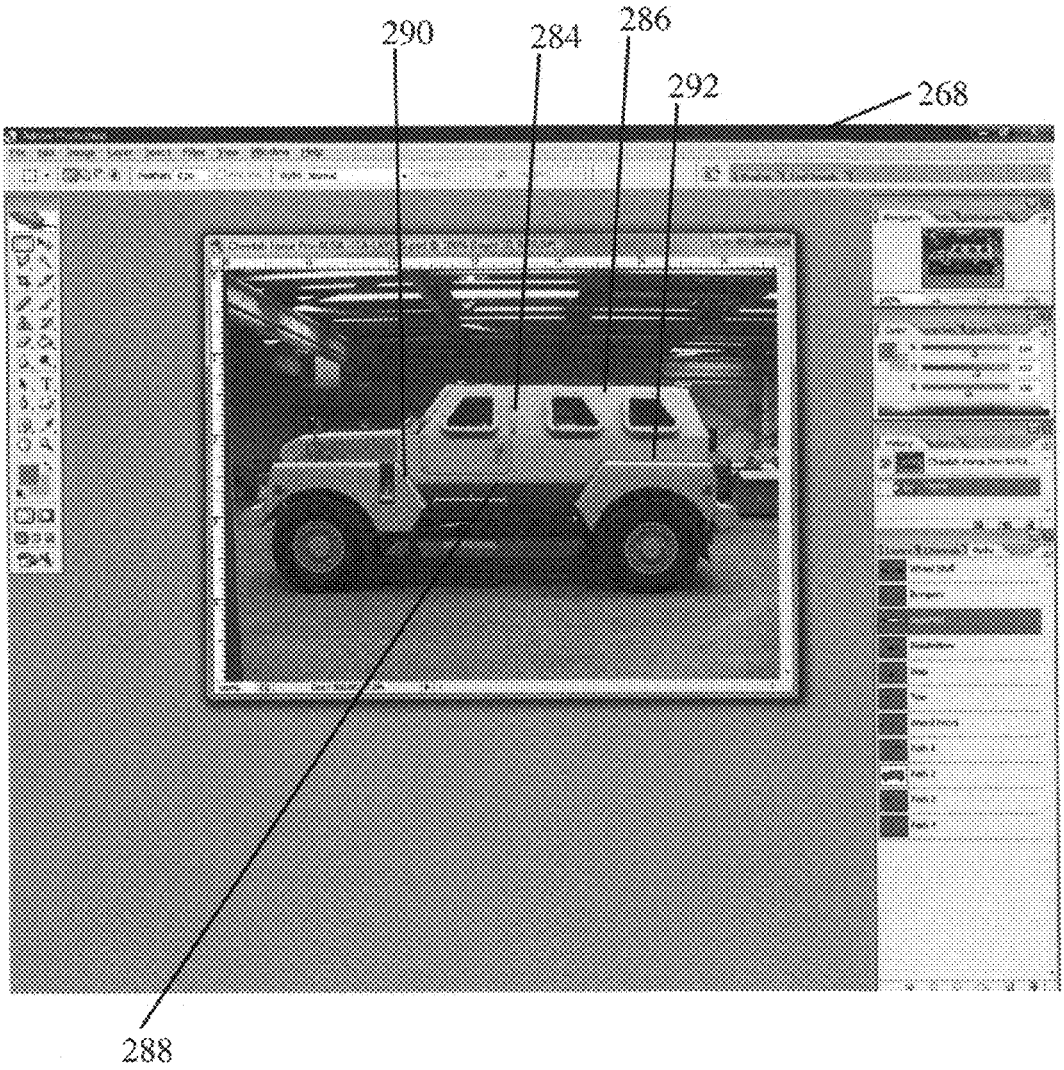

As described above, the panels can be installed on a physical item, so that the panels overlap each other. FIG. 27 illustrates two panels generally designated 150, 160 that can be placed on a physical item such as a structure or a vehicle. When placed on the physical item, the two panels 150, 160 can have an overlap generally designated 170. Each panel can have a length L. As shown in FIG. 27, the length L for each panel 150, 160 can be the same; however, in other embodiments the lengths of the panels that are to be placed beside each other can have different lengths.

First panel 150 can have a first side 152 and a second side 154. A portion of each side 152, 154 can be designated as an overlap area 156, 158, respectively. The overlap areas 156 and 158 can run the length L of first panel 150. Overlap area 156 can have a width with a distance $\mathbf{0}_1$ and overlap area 158 can have a width with a distance $0_2$. Distance $0_1$ and distance $0_2$ can be the same or different. Similarly, second panel 160 can have a first side 162 and a second side 164. A portion of each side 162, 164 can be designated as an overlap area 166, 168, respectively. The overlap areas 166 and 168 can run the length L of second panel 160. Overlap area 166 can have a width with a distance $0_2$ and overlap area 168 can have a width with a distance $0_3$. Distance $0_2$ and distance $0_3$ can be the same or different. Each overlap area 156, 158, 166, 168 can contain portions of the pattern printed on the respective panels 150, 160.

First panel 150 can be installed with overlap area 156 overlapping another panel (not shown) or it can be applied directed to the physical item with no overlap. Once installed, the second panel 160 can be installed such that overlap area 166 of the second panel 160 extends over overlap area 158 of the first panel 150 to create overlap 170. This overlap 170 helps to ensure good coverage, for example, of the physical item on which the panels 150, 160 are placed. As described above, the distance $0_2$ of overlap 170 and the distances $0_1$, $0_3$ depend on factors that can include, for example, intended use, environment of use, the type and size of the physical item, and the type of substrate, laminate or ink used. The overlap 170 can range from about 0.75 inches to about 3 feet depending on the application and the factors listed above. Overlap area 168 of second panel 160 can overlap another panel (not shown). Alternatively, overlap area 168 of second panel 160 does not have to overlap another panel.

The process of creating a site-specific camouflage pattern will be described in more detail below. The process can begin with a photographic image of a specific local terrain, nautical position, or airspace where a physical item will be located or operating. Alternatively, the photographic image can contain environmental characteristics which would be found in the intended operating environment of the physical item instead of being a specific image from the specific location of the physical item. As stated above, the physical item can include, but is not limited to any and all types of vehicles (land, air and sea, and rail/manned & unmanned), aircraft, watercraft, structures, buildings, pipes and piping, equipment, weapons, hardware, and other items used for military or other purposes.

Figure 6A:
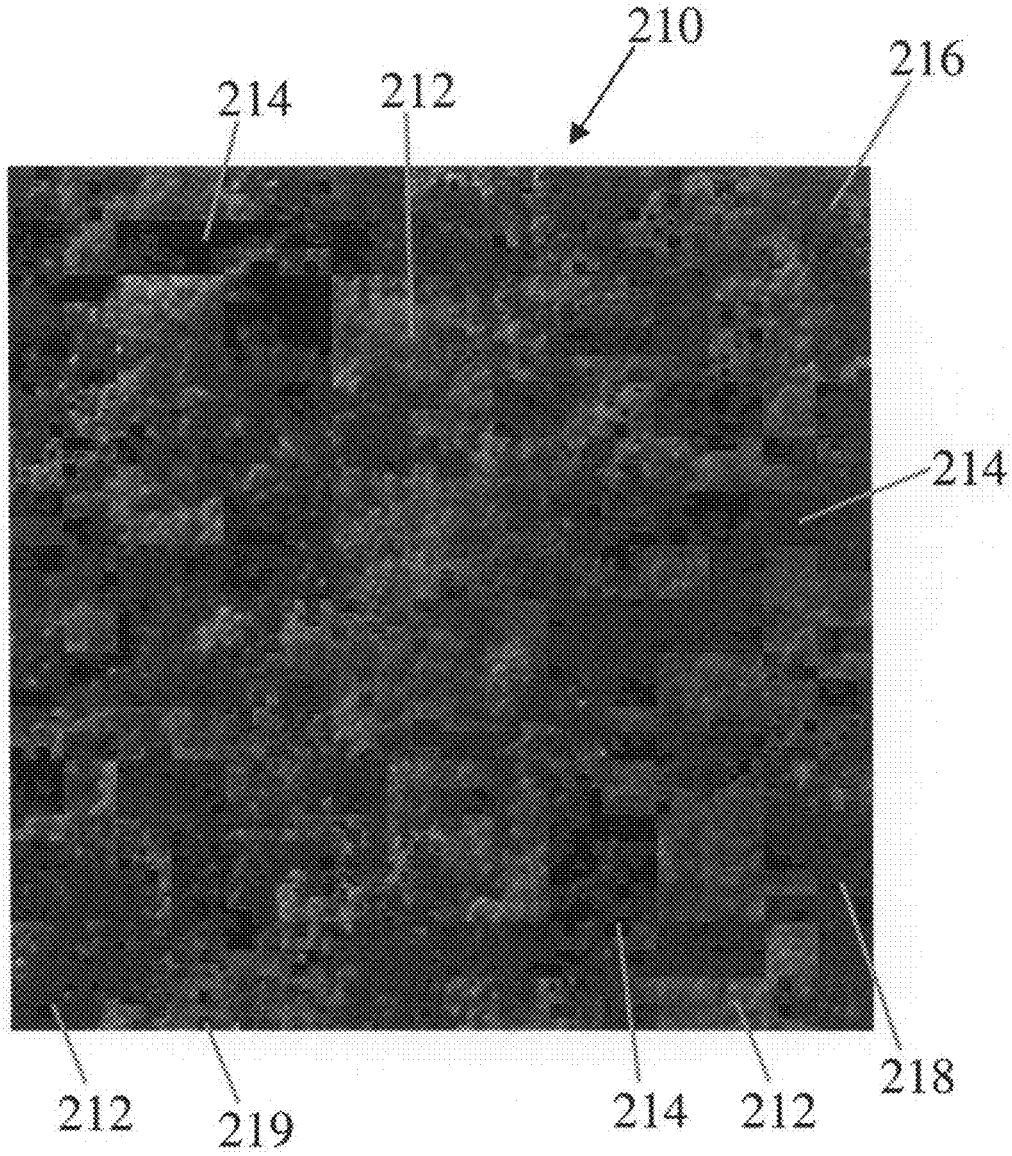
FIGS. 6A and 6B illustrate embodiments of a camouflage pattern or arrangement according to the present subject matter.
Figure 6B:
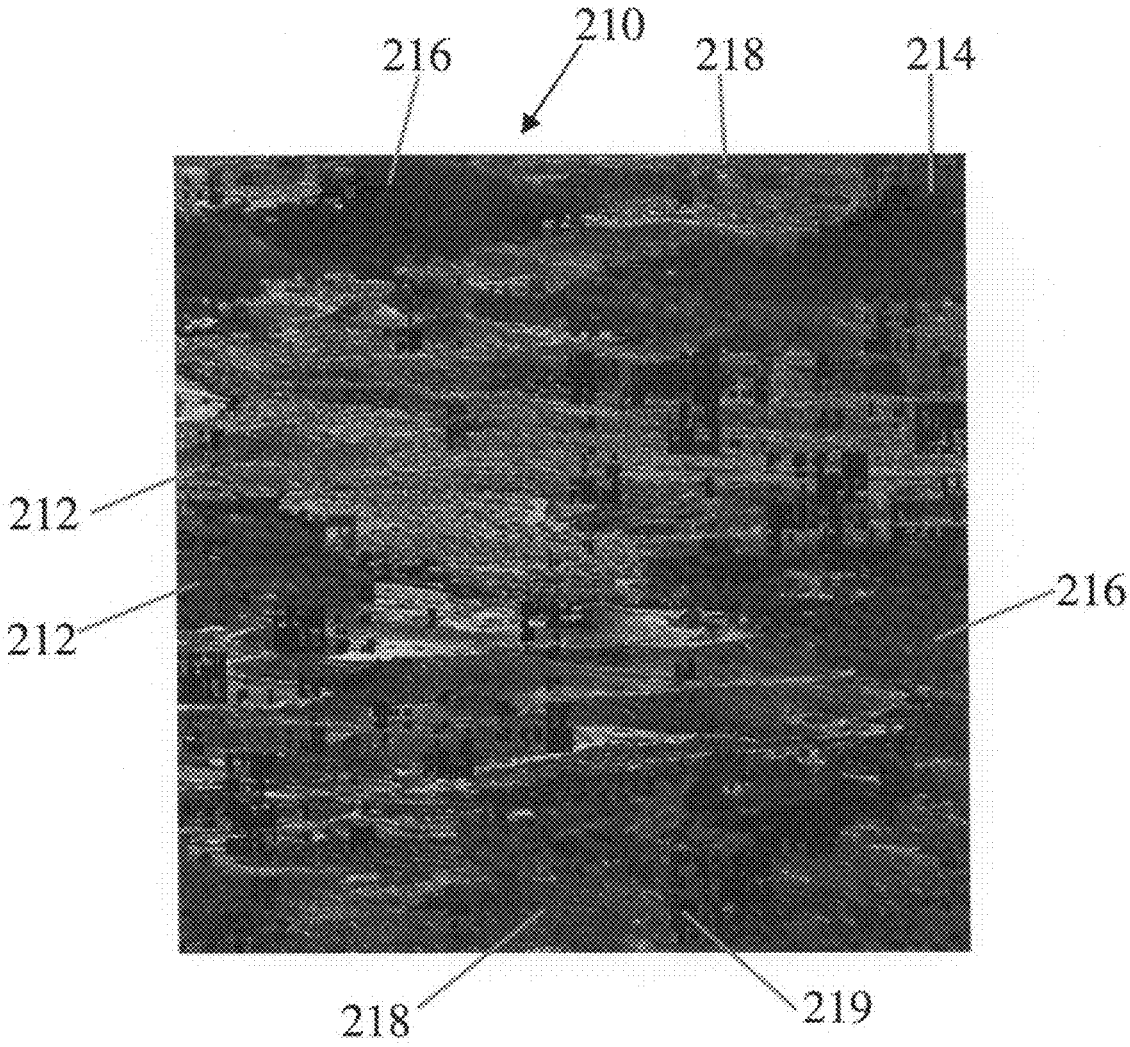

The photographic image can be digital and can then be manipulated such that site-specific photographic camouflage contains unnaturally occurring image distortions to aid in inhibiting the ability to easily distinguish proper depth of field perception. For example, FIGS. 6A and 6B illustrate different camouflage patterns generally 210, each of which includes portions or areas 212 of one or more photographic images that are site-specific for the intended operating environment in which the camouflage is to be used. The areas 212 can have different magnifications having different focal lengths creating distortions that are configured in disruptive patterns 214. For example, a specific area 216 of the areas 212 of one or more photographic images can be in focus at one focal length, while another specific area 218 of the areas 212 of one or more photographic images can have a different focal length that makes it more magnified. Further, micropatterns 219 can be added to further distort the image. The disruptive patterns 214 can be any shape from a structured shape to a generally amorphous shape as can be created by a pixel matrix.

Further, the camouflage 210 can have disruptive patterns having areas with an improper focal length that creates a blurred distortion that appears to be out of visual focus. For example, specific area 218 of the areas 212 of one or more photographic images can include portions of images that have an improper focal length and are slightly out of focus. Such disruptive patterns with blurred distortions can create further visual confusion for an observer and/or for an electronic or optical device. For example, for a physical item that contains images having multiple focal lengths and/or image portions having improper focal lengths that creates an out of focus portion beside an image portion that has a proper focal length and is in focus, an optical or electronic device that detects such a physical item will have difficulty focusing on the physical item and/or determining a correct distance between the device and the physical item. Such visual confusion aids in camouflaging and protecting the physical item.

Figure 7A:
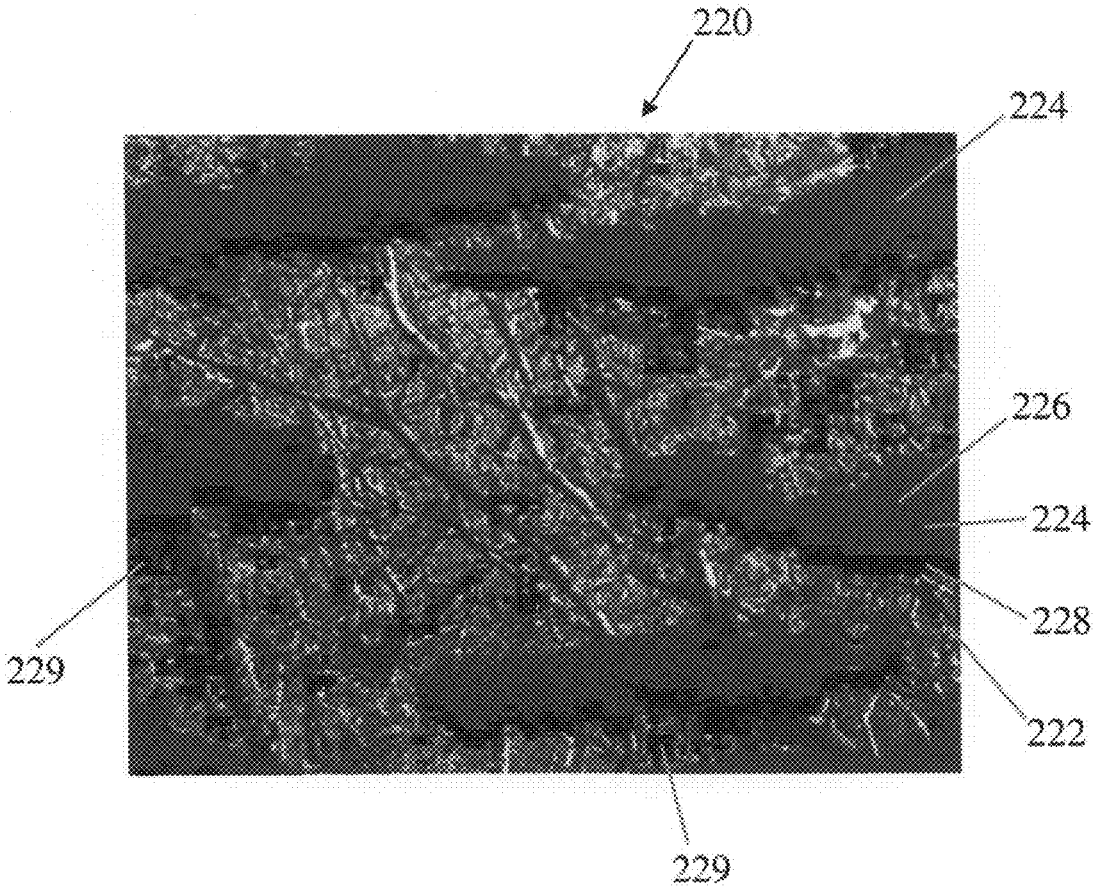
FIGS. 7A and 7B illustrate other embodiments of a camouflage pattern or arrangement according to the present subject matter.
Figure 7B:
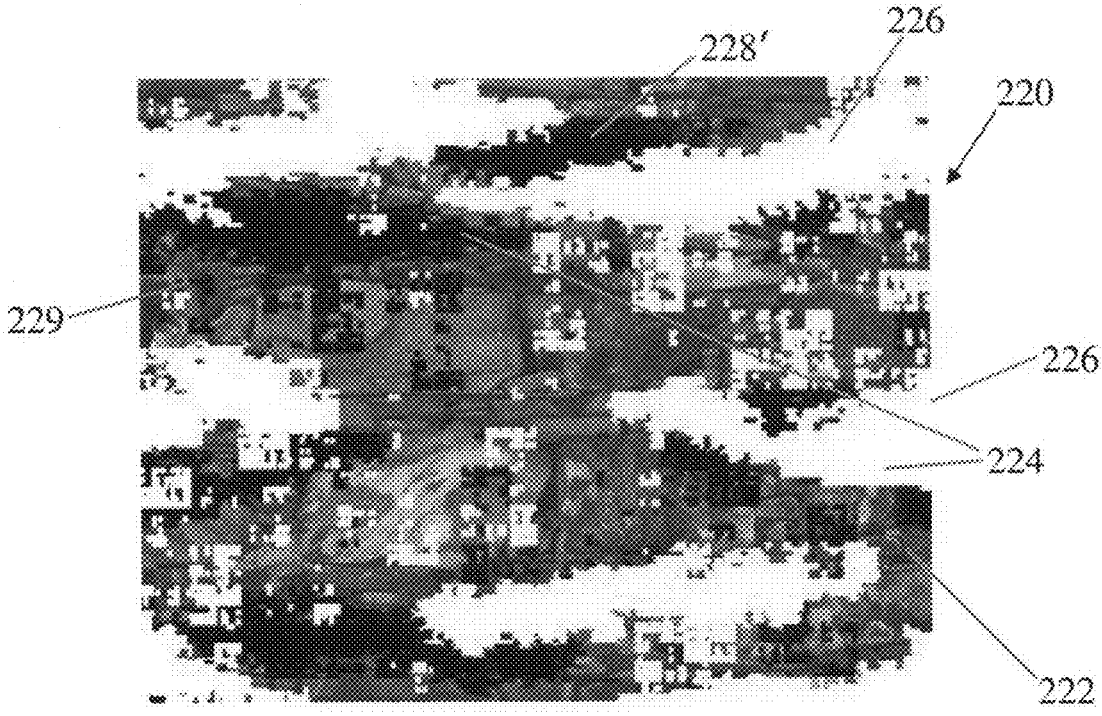

FIGS. 7A and 7B illustrate other examples of a camouflage pattern generally 220, each of which includes photographic image 222 that is site-specific to the intended operating environment in which the camouflage is to be used. One or more disruptive patterns 224 of one or more colors selected from a range of colors can be placed over the photographic image 222 to create distortions. The range of colors can come from the palate of colors in the photographic image and/or an operating environment in which the camouflage is intended to be used. For example, the disruptive pattern 224 as shown in FIG. 7A can include a first portion, or top portion, 226 that overlays a shadow portion 228. Alternatively, the disruptive patterns 224 can include a first disruptive pattern 226 and a second disruptive pattern 228' that may overlap some, but do not necessarily mirror each other as shown in FIG. 7B. Further, micropatterns 229 can be added to further distort the photographic image. There are at least two disruptive patterns that can be included in the camouflage pattern. The disruptive patterns 224 can be any shape from a structured shape to a generally amorphous shape. The randomness of such shapes may be limited by the pixel matrix of the image, if it is a digital image. Placement of unnaturally occurring colored disruptive patterns and micro patterns on the original site-specific photographic image disrupts the contour of the camouflaged object and breaks up the visual pattern and distinguishable shape of the object.

Figure 8:
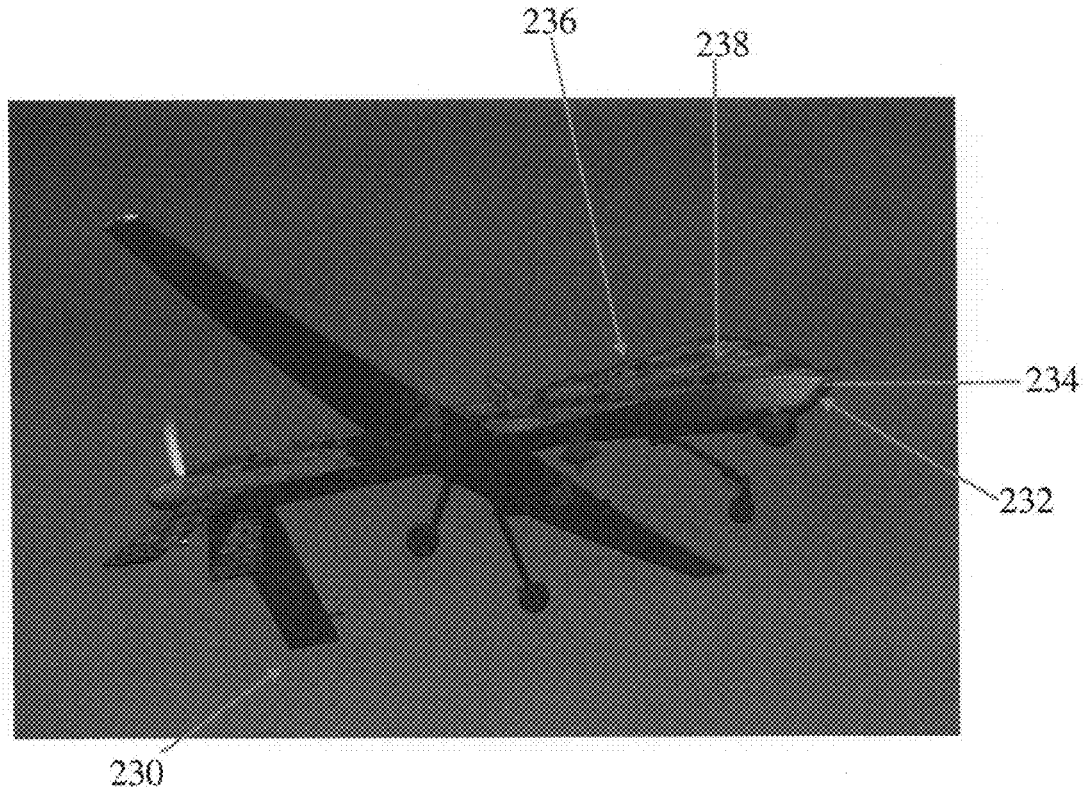
FIG. 8 illustrates a perspective view of a physical item having embodiments of a camouflage pattern or arrangement placed thereon according to the present subject matter.

When applied, the camouflage can create multiple viewing angles. For example, as shown in FIG. 8, a drone plane, generally 230, can have an underside 232 that has a site-specific visually distorted blue sky image 234 thereon and a topside 236 that has site-specific visually distorted image 238 having the characteristics of the surrounding landscape as looking down from above. The image 238 of the drone plane 230 in FIG. 8 has on its top side 236 unnaturally occurring magnifications and disruptions of site-specific photo images similar to the camouflage 210 of FIG. 7B.

Through the use of micropatterns and disruptive patterns of colored shapes and/or side-by-side areas within the camouflage that contain photo images at competing or contrasting focal lengths, a visual confusion and a disruption, or breaking up of the outline of the camouflaged object can be achieved. In this manner, the camouflage 210, 220 can be created with a generally seamless continuation of other naturally occurring features and landscapes that continue into the horizon. A synthesized but realistic perspective arrangement in a given environment is not necessarily sought. Rather, a principal purpose is to cause visual confusion by disguising and breaking up the recognizable form of the object. Another purpose is to inhibit depth perception by interfering with primary ways one perceives depth.

For example, depth from focus can be inhibited. The lens of the eye can change its shape to bring objects at different distances into focus. Knowing at what distance the lens is focused when viewing an object means knowing the approximate distance to that object. The discontinuous pattern of the camouflage creates no regular continuously repeatable pattern coinciding with the natural environment. This jumble of shapes goes against the Gestalt Law of continuity, and makes it harder to see.

Another example, depth from relative size can be inhibited. An automobile that is close to a person looks larger to that person than one that is far away; the human visual system exploits the relative size of similar (or familiar) objects to judge distance. The pattern of differing focal differences within the created pattern described herein creates visual confusion by making it harder to judge relative size.

Depth perceived from motion can also be inhibited. A form of depth from motion, kinetic depth perception, is determined by dynamically changing object size. As objects in motion become smaller, they appear to recede into the distance or move farther away; objects in motion that appear to be getting larger seem to be coming closer. This is a form of kinetic depth perception. Using kinetic depth perception enables the brain to calculate time to crash distance (TTC) at a particular velocity. When driving, we are constantly judging the dynamically changing headway (TTC) by kinetic depth perception. The patterns described herein confuse or complicate the determination of kinetic depth perception by the inherent differing magnifications or disruptions rendering the true object size more difficult to perceive, and thereby interfering with kinetic depth perception.

Referring to FIGS. 9-15, a process for creating a camouflage from a site-specific digital photographic image using colored disruptive patterns is described in detail. First, a digital photographic image 40 is procured or obtained that can be used in an intended operating environment. For example, suitable high megapixel digital still photographs of the specific terrain, nautical position, or airspace which the user will be operating can be acquired. These digital still photographs can be obtained in different manners and using different equipment. For example, the digital still photographs can be obtained through digital still cameras, high definition and standard definition video cameras, or satellite imagery.

Once obtained, the digital photographic image 240 in the form of a high megapixel digital still photograph, for example, is the starting point for the camouflage, concealment or deception pattern to be created and later applied to a physical item such as a military vehicle (land, air or sea), structure, weapon, hardware, fabric, netting, mesh, or equipment. A suitable digital photographic image or images 240 can contain a very precise match to the specific operating environment by being high megapixel photo duplicates of the environment. Alternatively, a suitable digital photographic image or images 240 can contain environmental characteristics which would be found in the intended operating environment of the physical item The photographs can be from different viewing perspectives to allow the capability to design appropriate camouflage that will be effective from different viewing perspectives (when viewed from above, on any side, or when necessary viewed from below). For example, as illustrated in FIG. 9, if the physical item to be camouflaged is to reside or operate within a desert environment, the digital photographic image 240 can reflect the general characteristics of a desert environment or can be from the actual desert location in which the camouflaged physical item will reside and/or operate.

Figure 9:
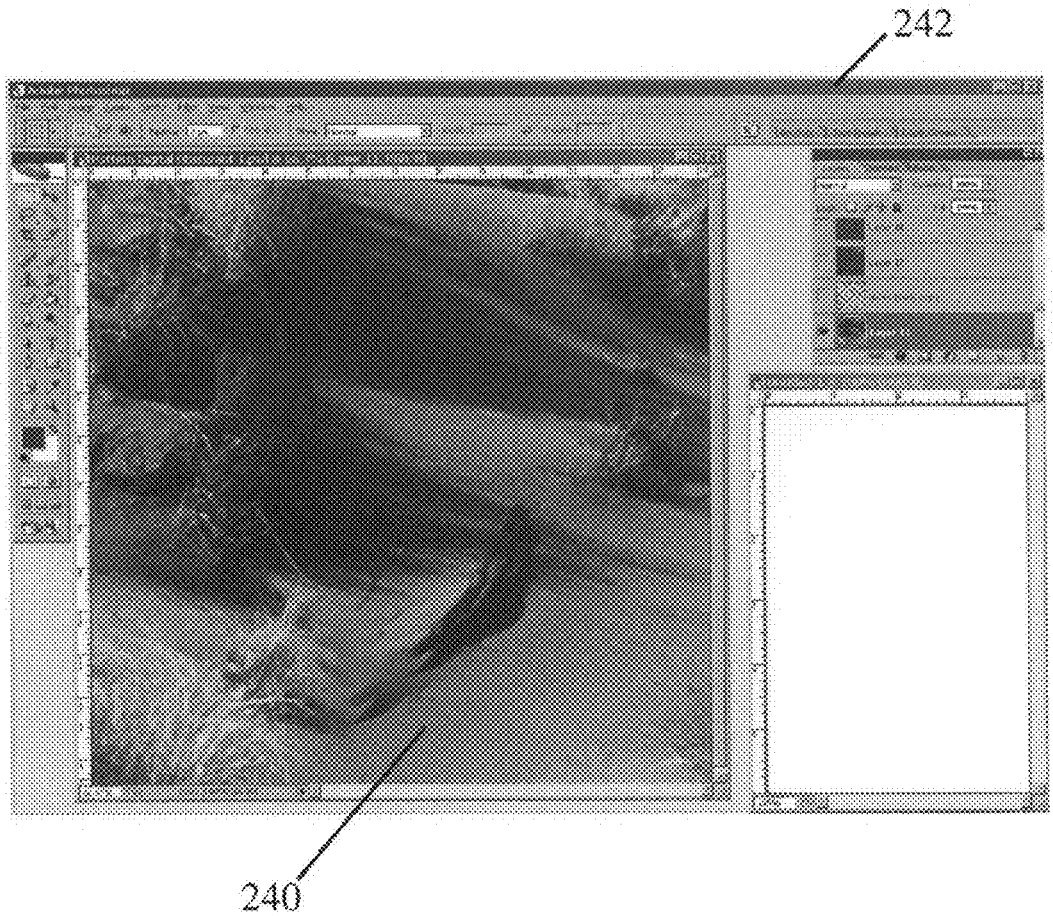
FIGS. 9-15 illustrate steps for creating embodiments of a camouflage pattern or arrangement according to the present subject matter.

The digital photographic image 240 is opened on the computer in an image-editing program 242 as shown in FIG. 9 so that the digital photographic image 240 can be enhanced to create a camouflage pattern for concealment or deception purposes. The image-editing program can be, for example, PHOTOSHOP® offered by Adobe Systems Incorporated, San Jose Calif. Other image-editing programs can include equivalent photo manipulation and editing software programs such as PAINT.NET® and PICASA®, or the like, or, in the case of video footage, the image-editing programs can include appropriate video editing software programs that will produce a digital still frame photographic image.

Figure 10:
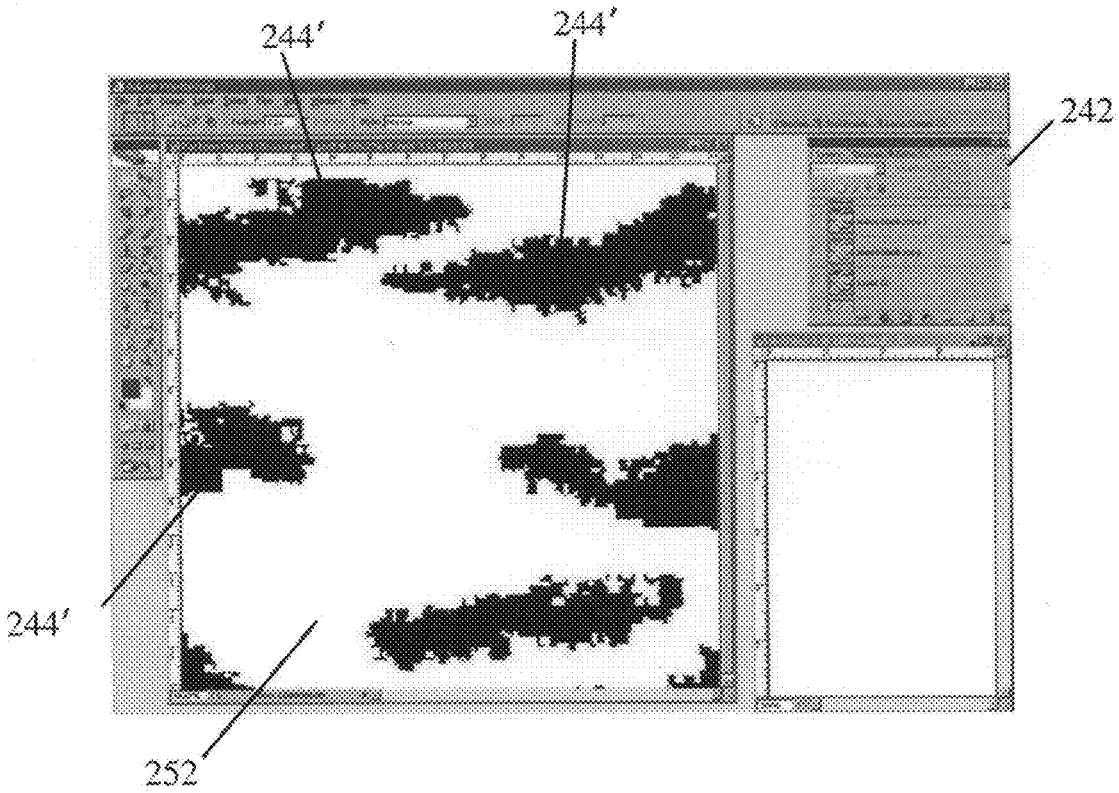
Figure 11:
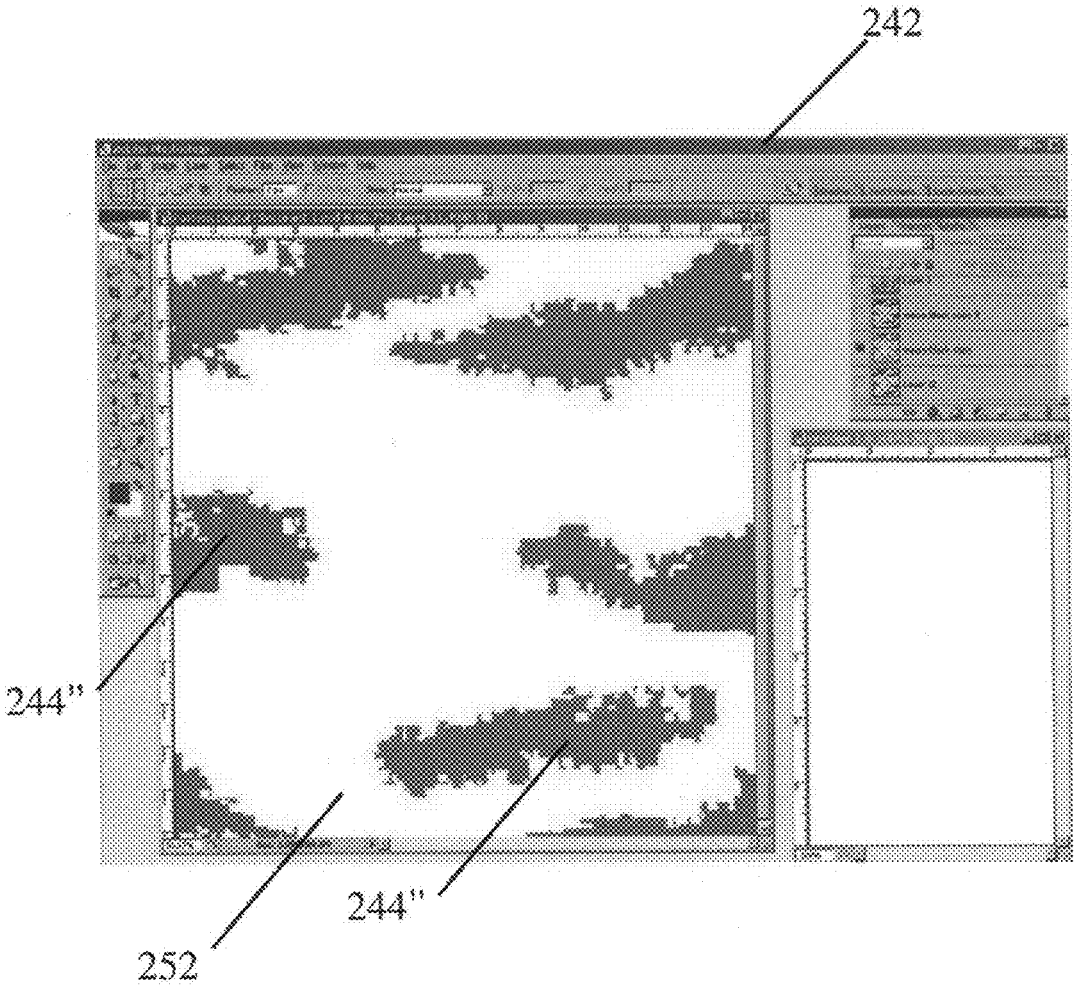
Figure 12:
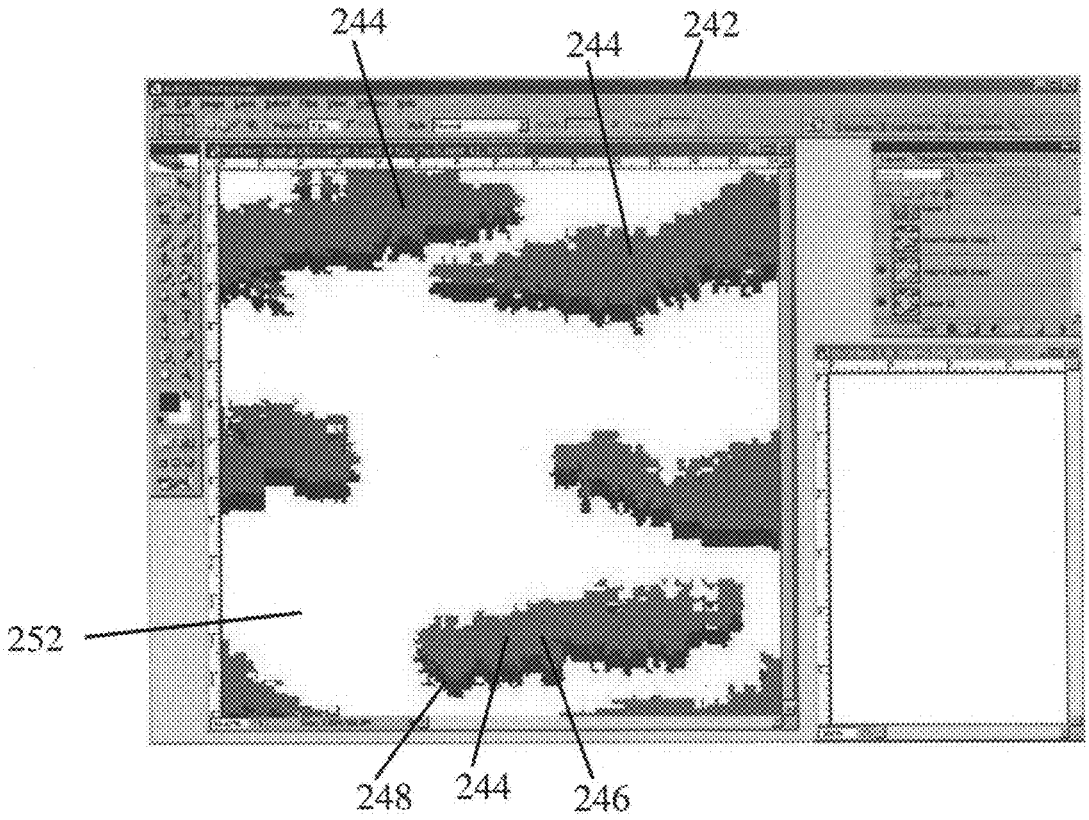

Next, the digital photographic image 240 can be manipulated by adding "disruptive patterns" to break-up or hide the contour of the physical item to be camouflaged or concealed as an aid in causing visual confusion. As shown in FIGS. 10-12, the imaging-editing program 242 can be used to generate a disruptive pattern 244 (see FIG. 12) on a gray scale 252 that can be placed over the digital photographic image 240. As shown in FIG. 10, shapes 244' can be generated in the image editing program 242 to create the foundation of the disruptive pattern 244 (see FIG. 12). The disruptive pattern 244 can contain any shapes. As shown in FIG. 10, the shapes 244' of the disruptive pattern can be generally amorphous. Alternatively, in some embodiments, the shapes 244' can be specific geometrical structures.

Figure 5:
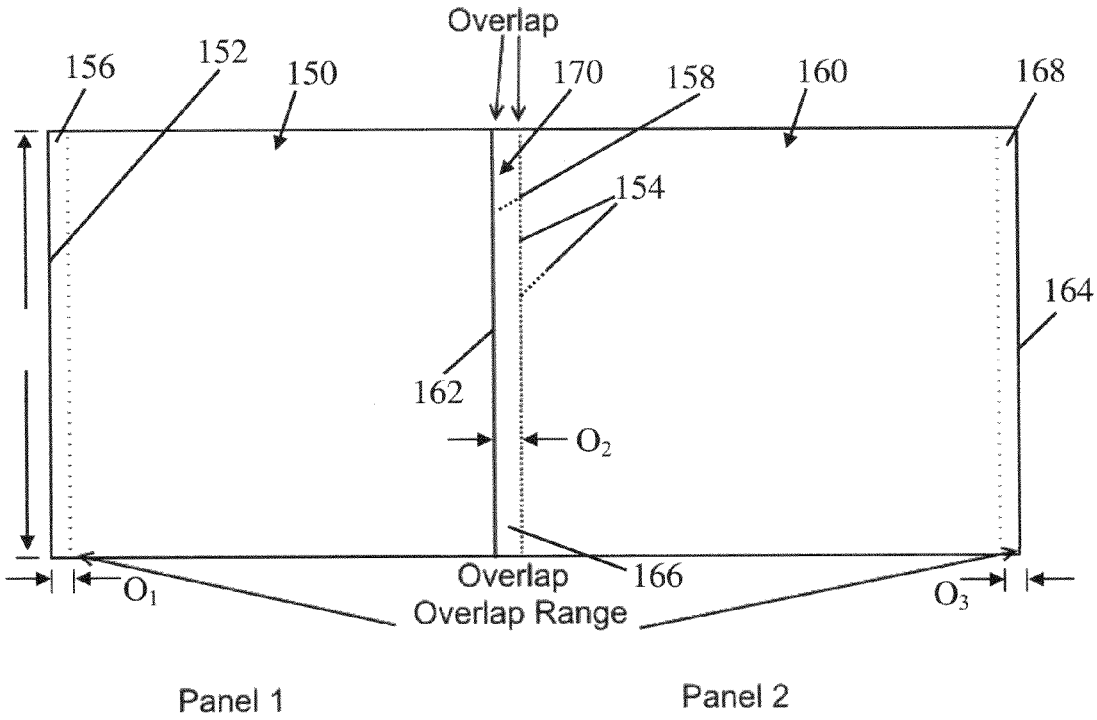
FIG. 5 illustrates an embodiment of panels having a camouflage pattern printed thereon that can be attached to a physical item according to the present subject matter.

The shapes 244' of the disruptive pattern shown in FIG. 5 can be of a size that is relative to the scale and size of the digital photographic image 240 (see FIG. 9) so as to not overwhelm the digital photographic image 240. In a similar manner, the proximity, or distance, between the shapes 244' of the disruptive pattern, can be close enough so as to facilitate the creation of visual confusion when positioned on the digital photographic image 240, but far enough apart from each other to not overwhelm the digital photographic image 240. For this reason, the size and shape of the shapes 244' can affect the number of shapes 244' within a given disruptive pattern.

The shapes 244' of the disruptive pattern shown in FIG. 10 can be colored to create colored shapes 244" as shown FIG. 11. The one or more colors can be selected from a range of colors suitable for the intended operating environment in which the camouflage is to be used. For example, the one or more colors can be selected from a range of colors from the digital photographic image 240 and/or the operating environment in which the camouflage is intended to be used. More than one color can be used to color the different shapes. For example, some of the shapes can be one color and other shapes can be another color as shown in FIG. 7B.

Figure 14:
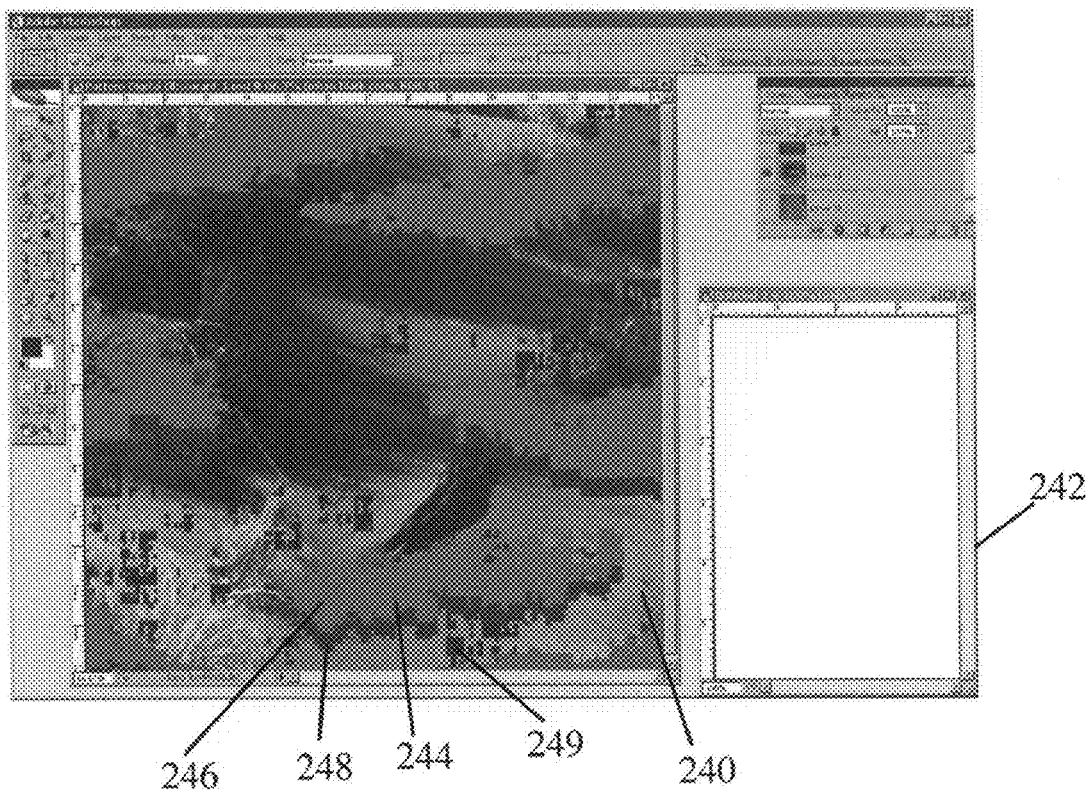

To create the final disruptive pattern 244 as used in the example of a camouflage pattern 250 shown in FIG. 14, the disruptive pattern 244 can include a top portion 246 and have a shadow portion 248 added to mirror or shadow the top portion 246 as shown in FIG. 12. The shadow portion 248 can be a darker shade or color as compared to the top portion 246. The shadow portion 248 can underlie the top portion 246 so as to create a shadow effect. The shadow effect of the top portion 246 and the shadow portion 248 add depth to the disruptive pattern 244 to further facilitate the visual confusion caused by the disruptive pattern 244.

Figure 13:
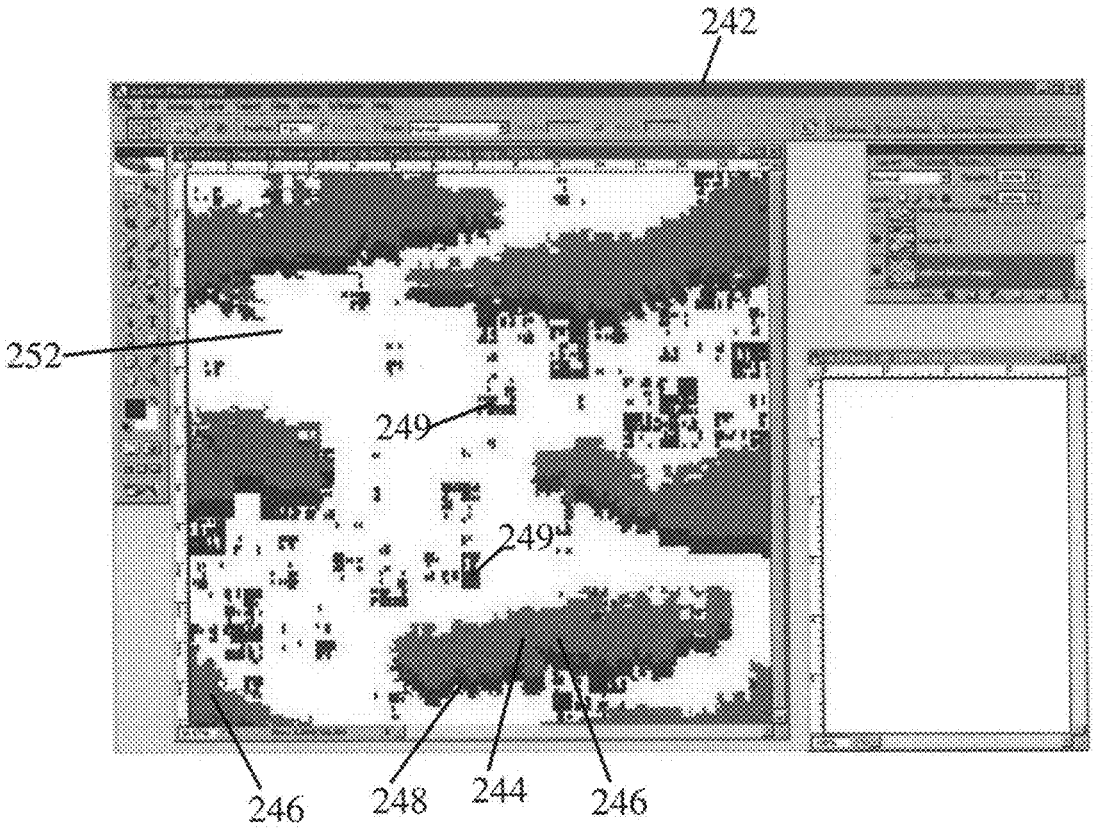

As shown in FIG. 13, additional micropatterns 249 can be added to increase the visual confusion. The additional micropatterns 249 are smaller patterns than the disruptive patterns 244 and can be a generally amorphous shape. The micropatterns 249 can include one or more additional colors not used in the disruptive pattern from the range of colors from the digital photographic image 240 and/or the operating environment in which the camouflage is intended to be used. The image-editing program can include computer assisted photo illustration software tools to add these micropatterns 249 to the suitably chosen digital photographic image 240. The micropatterns 249 can be randomly dispersed over the area of the field of the digital photographic image 240 in the camouflage pattern 250 as shown in FIG. 14. As shown in FIG. 14, the micropatterns 249 when added to together with disruptive pattern 244 should not create patterns so dense as to overwhelm the digital photographic image 240 of the camouflage pattern 250.

As shown in FIGS. 10-13, after the selection of the digital photographic image 240, the creation of one or more colored disruptive patterns 244 and the micropatterns 249 can be accomplished in the image-editing program 242 on a gray scale background 252. Once the disruptive patterns 244 and the micropatterns 249 are created, the digital photographic image 240 can be opened again in the image-editing program 242 and the disruptive pattern 244 and micropatterns 249 can be configured on the digital photographic image 240 to create the camouflage pattern 250. In this manner, a digital photograph of the specific real operating environment can be manipulated to cause visual confusion due to disruptive patterning.

Once a suitable digital photographic image 240 of the operational environment has been acquired, and it is enhanced to improve its camouflage effect, digital copies of the created photographic camouflage pattern 250 can be saved at varying sizes for different sized applications on the computer or a memory device, such as a compact disk, a floppy disk, a portable zip drive, a memory drive, or the like. A "proof" sample can be printed out at this stage to check and see if color, clarity, and depth are achieved.

Figure 15:
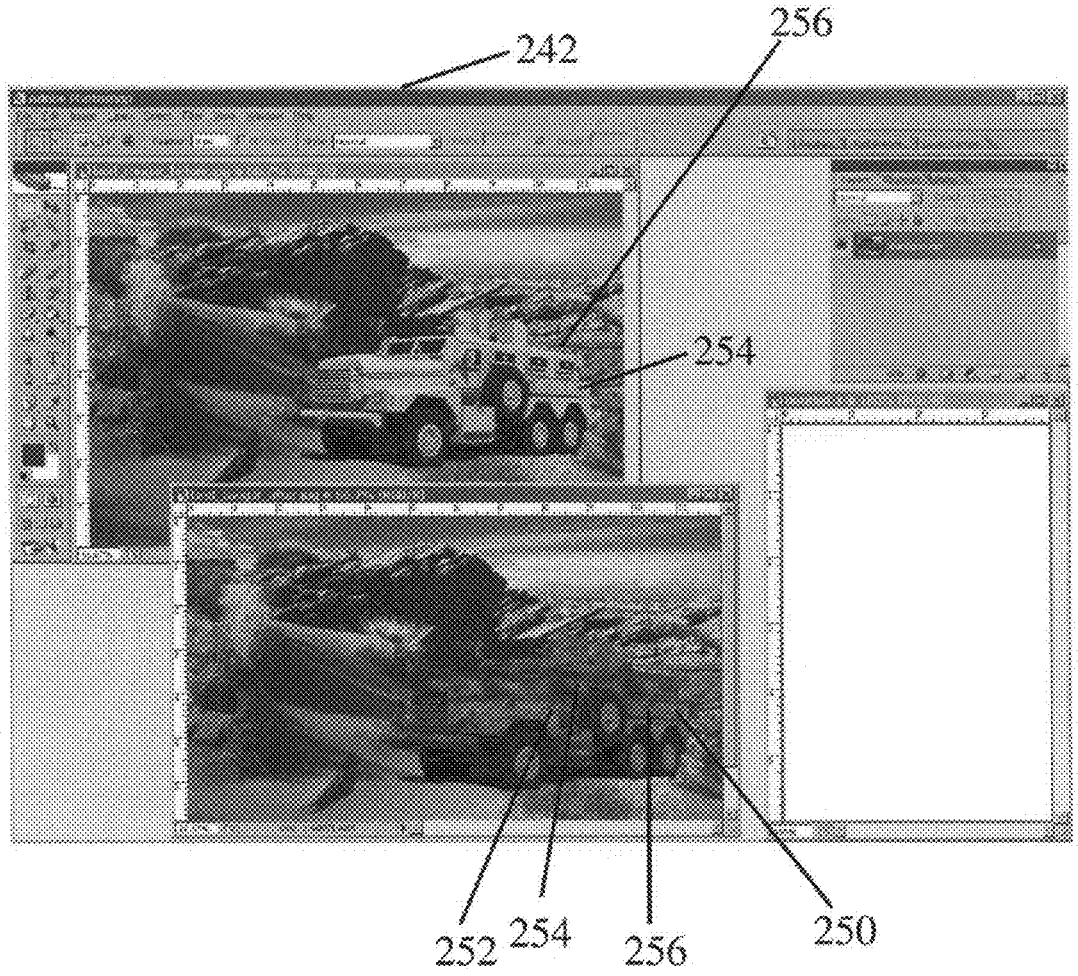

Next, a mock-up can now be created using the image-editing program 242 as shown in FIG. 15. Images of the particular physical item 254, such as a vehicle can be opened. The images of physical item 254 are digital, scaled-down versions of the vehicle for which the camouflage pattern 250 is designed. The images of physical item 254 can serve as an object template 256. This image can be a true to scale template. Therefore, when the camouflage is taken to a direct application, the measurements remain correct when printed in actual size. Lines can be added to the object template 256 to identify where the panels of camouflage would be on the vehicle.

The appropriate size of the previously saved photographic camouflage pattern 250 that best corresponds with the size of the physical item 254 to be camouflaged can be chosen and applied to the object template 256. Appropriate shading based on the shadows created by the physical item 254 can be used to create a general likeness of the physical item 254 as it would appear upon being camouflaged. This shading facilitates the determination of the viability of the created camouflage pattern. If the desired camouflage effect is achieved, further steps can be taken to create a camouflage material which will be described in greater detail below.

Alternatively, a process for creating a camouflage from a site-specific digital photographic image employing distortion disruptive patterns of images having different focal lengths can be used. In one embodiment, such a camouflage pattern can be created by placing smaller photographs or photograph sections layered over the original, or base, digital photographic image to achieve the desired disruptive effect that aids in the cause of visual confusion by inhibiting normal depth perception. This use of photo-over-photo technique achieves both a disruptive effect and makes the camouflage have a visual confusing effect at different focal distances.

In the embodiment shown in FIGS. 16-29, a process for creating a camouflage from site-specific digital photographic images using disruptive patterns of images having different focal lengths is described in more detail. As in this example, the camouflage pattern can be developed from a plurality of site-specific digital photographic images. First, two or more digital photographic images are procured or obtained that can be used in an intended operating environment. The digital photographic images can be site-specific photographic images.

Figure 16:
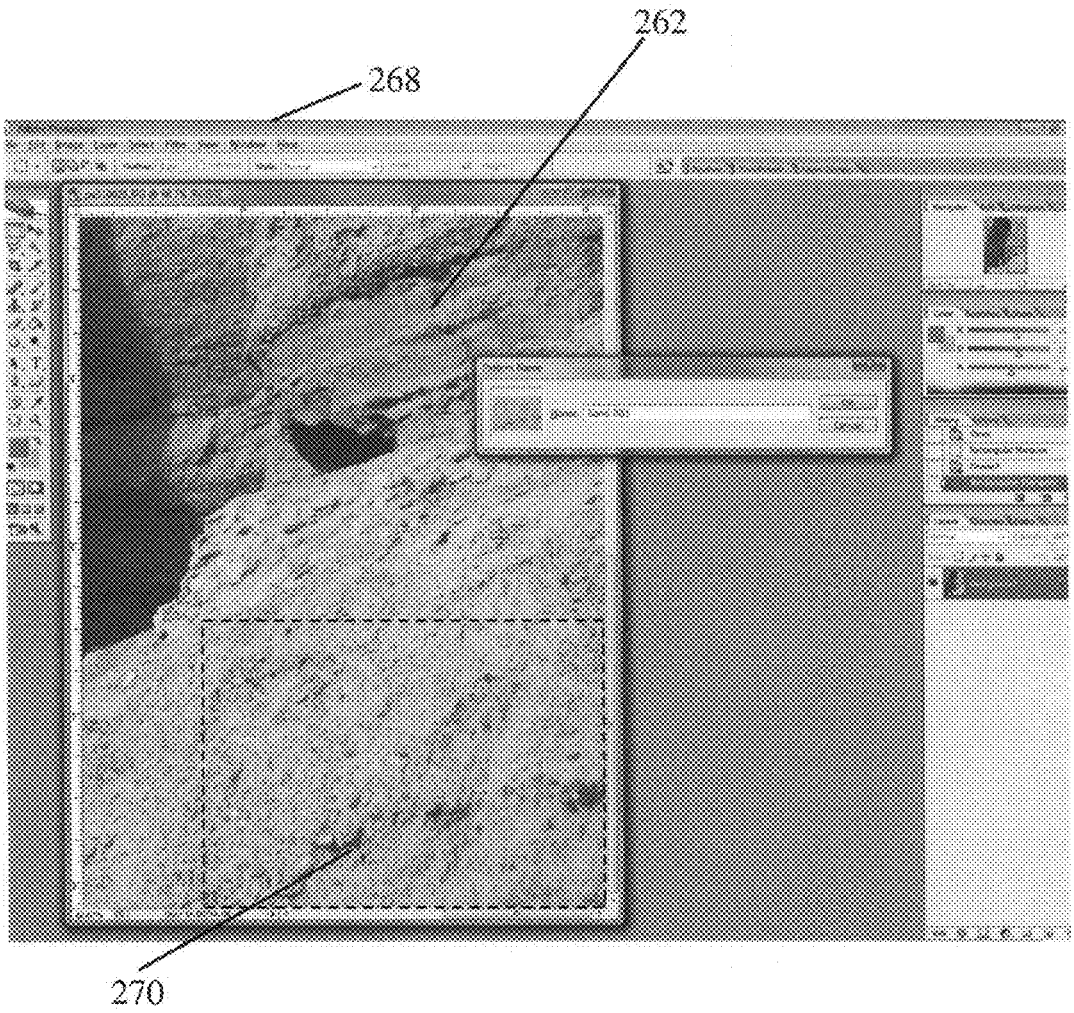
FIGS. 16-25 illustrate steps for creating other embodiments of a camouflage pattern or arrangement according to the present subject matter.
Figure 17:
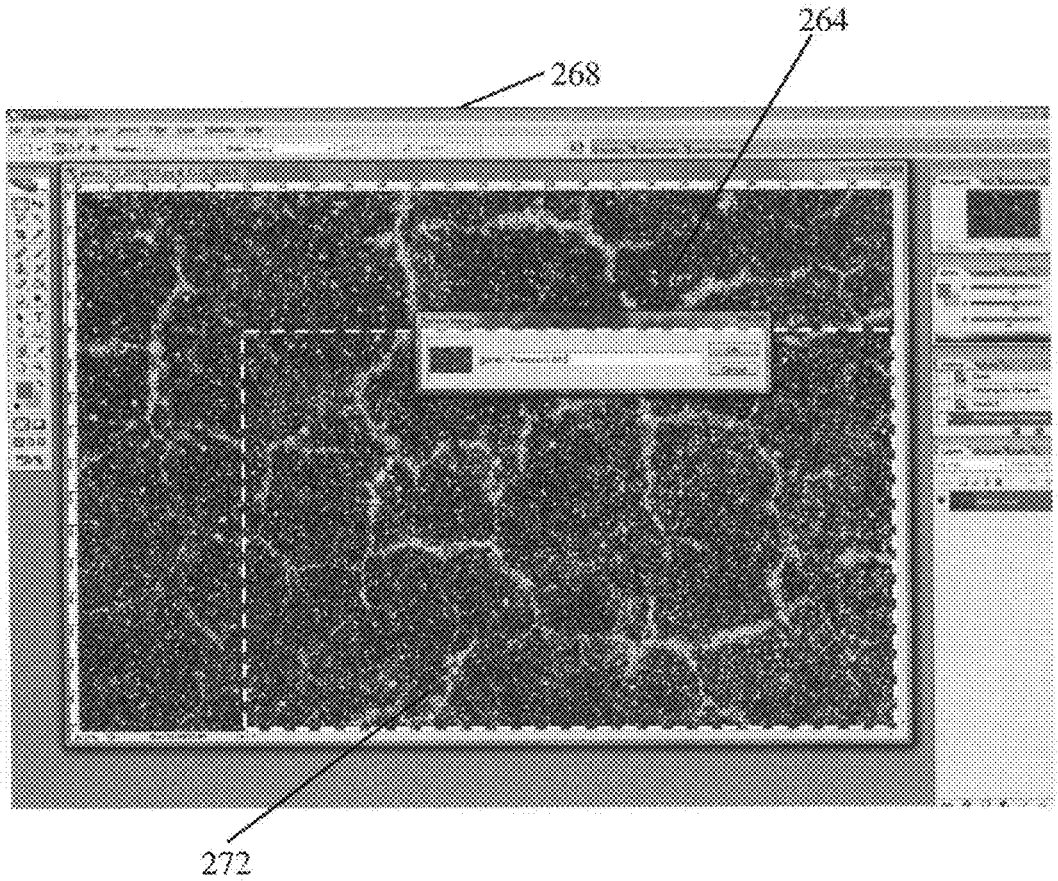
Figure 18:
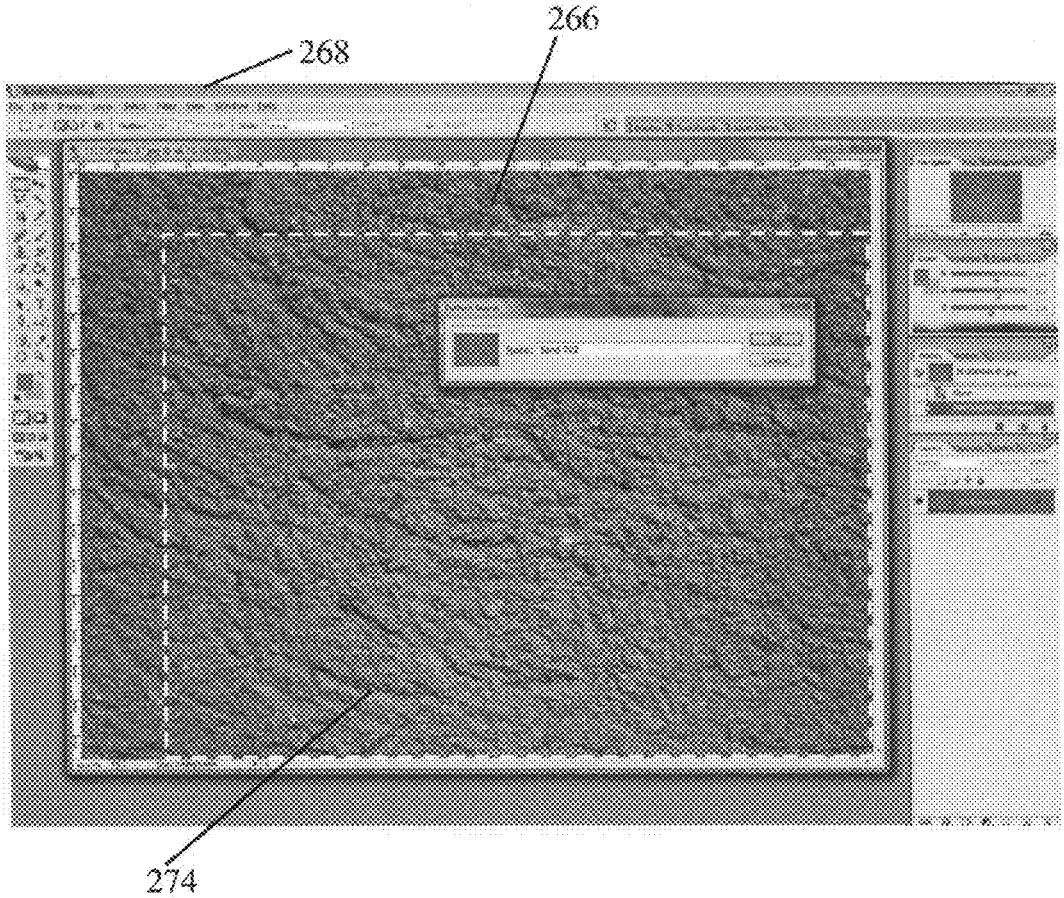

In the example shown in FIGS. 16-29, desert site-specific camouflage 260 (see FIG. 25) is being created from three site-specific photographic images 262, 264, 266 (see FIGS. 16-18, respectively). The digital photographic image 262 shown in FIG. 16 is a site-specific image of a portion of a sandstone landscape. The digital photographic image 264 shown in FIG. 17 is a site-specific image of a portion of weather worn desert pavement at a shorter focal length than that of digital photographic image 262. The digital photographic image 266 shown in FIG. 18 is a site-specific image of a different portion of a sandstone landscape than that of the digital photographic image 262. As can be seen, the digital photographic image 266 has a much shorter focal length than the digital photographic image 262. Thus, three different photographic images 262, 264, 266 having different focal lengths are provided. Further, the three different photographic images 262, 264, 266 are of site-specific elements common to the intended operating environment in which the developed camouflage will be used.

Each digital photographic image 262, 264, 266 can be opened on the computer in an image-editing program 268 as shown in FIGS. 16-18 so that the digital photographic images 262, 264, 266 can be manipulated to create a camouflage pattern for concealment or deception purposes. In FIG. 16, the digital photographic image 262 is opened in the image-editing program 268 on a computer and an image of an area 270 of the digital photographic image 262 can be isolated to be used in creating the camouflage. Similarly, the digital photographic image 264 is opened in the image-editing program 268 as shown in FIG. 17 and an image of an area 272 of the digital photographic image 264 can be isolated using the image-editing program 268. The digital photographic image 266 can also be opened in the image-editing program 268 as shown in FIG. 18 and an image of an area 274 of the digital photographic image 266 can be isolated to be used in creating the camouflage.

Again, each digital photographic image 262, 264, 266 is of a different area with a different focal length resulting in different magnification. If necessary, the isolated images of the respective areas 270, 272, 274 of the digital photographic images 262, 264, 266 can be further enhanced to differentiate the magnifications.

Figure 19:
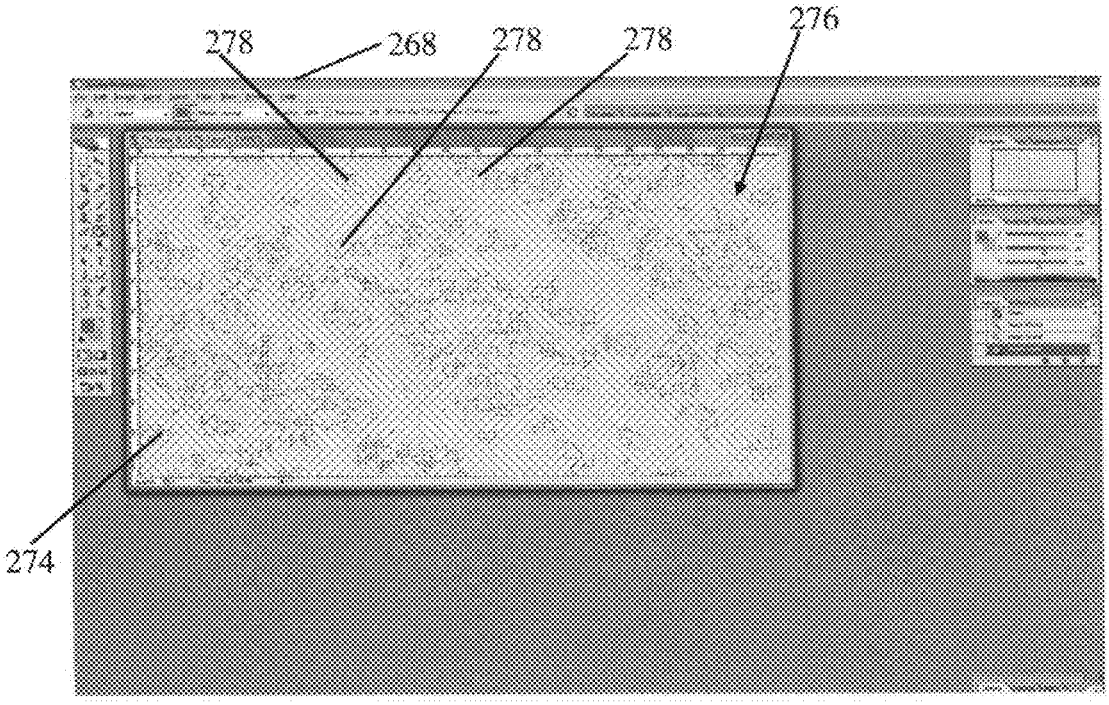
Figure 20:
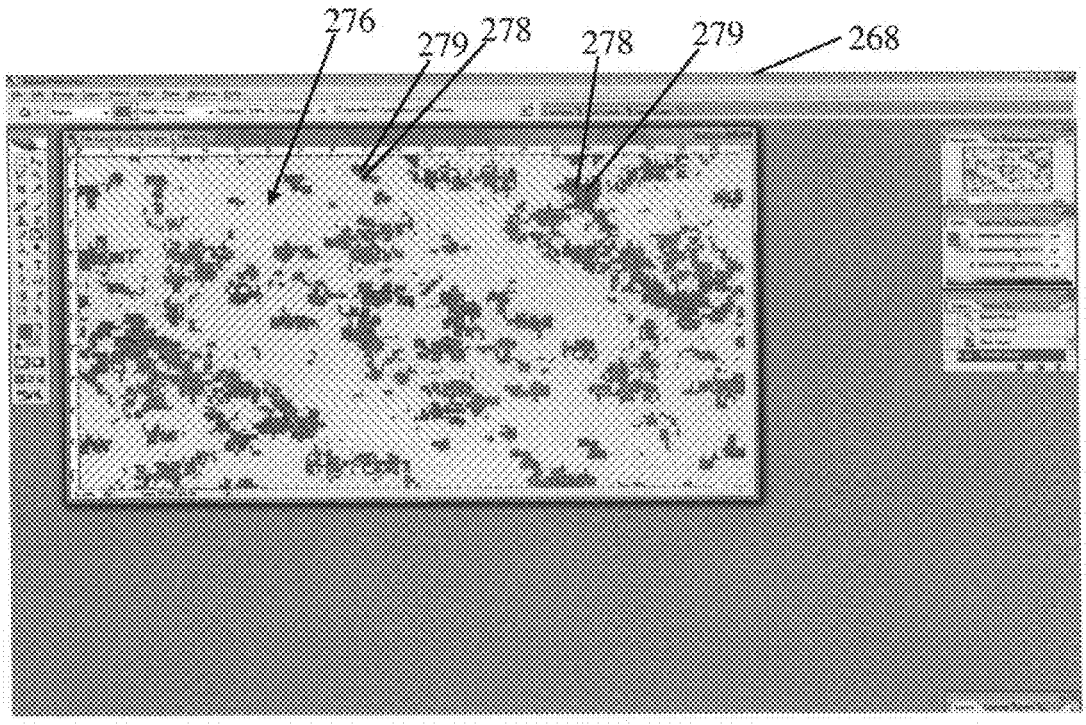

Before or after the images of the respective areas 270, 272, 274 of the digital photographic images 262, 264, 266 are isolated, a template of disruptive patterns can be created on a gray scale generally 276 (see FIG. 19) using the image-editing program 268 with different disruptive patterns identified to receive a different respective isolated image of the respective areas 270, 272, 274 of the digital photographic images 262, 264, 266. As shown in FIG. 19, a first disruptive pattern 278 can be generated or added to the gray scale 276. As described above, the disruptive pattern can be any shape. In the embodiment shown, the disruptive pattern 278 is a generally amorphous shape. This first disruptive pattern 278 can receive portions of an image from one of the areas 270, 272, 274 from one of the respective digital photographic images 262, 264, 266. As shown in FIG. 20, the image-editing program 268 can be used to drop in portions 279 of the image of the area 274 from the digital photographic image 266. In this manner, the image of the area 274 is applied to the first disruptive pattern.

Figure 21:
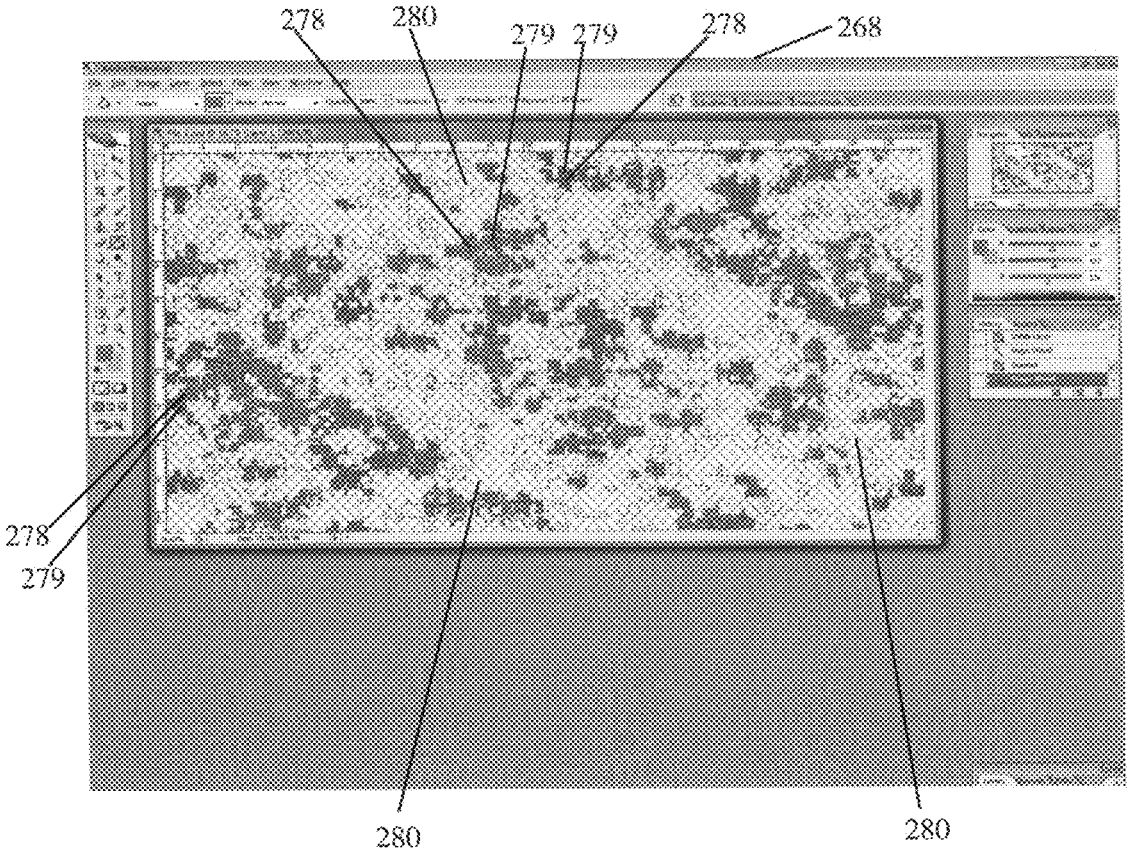
Figure 22:
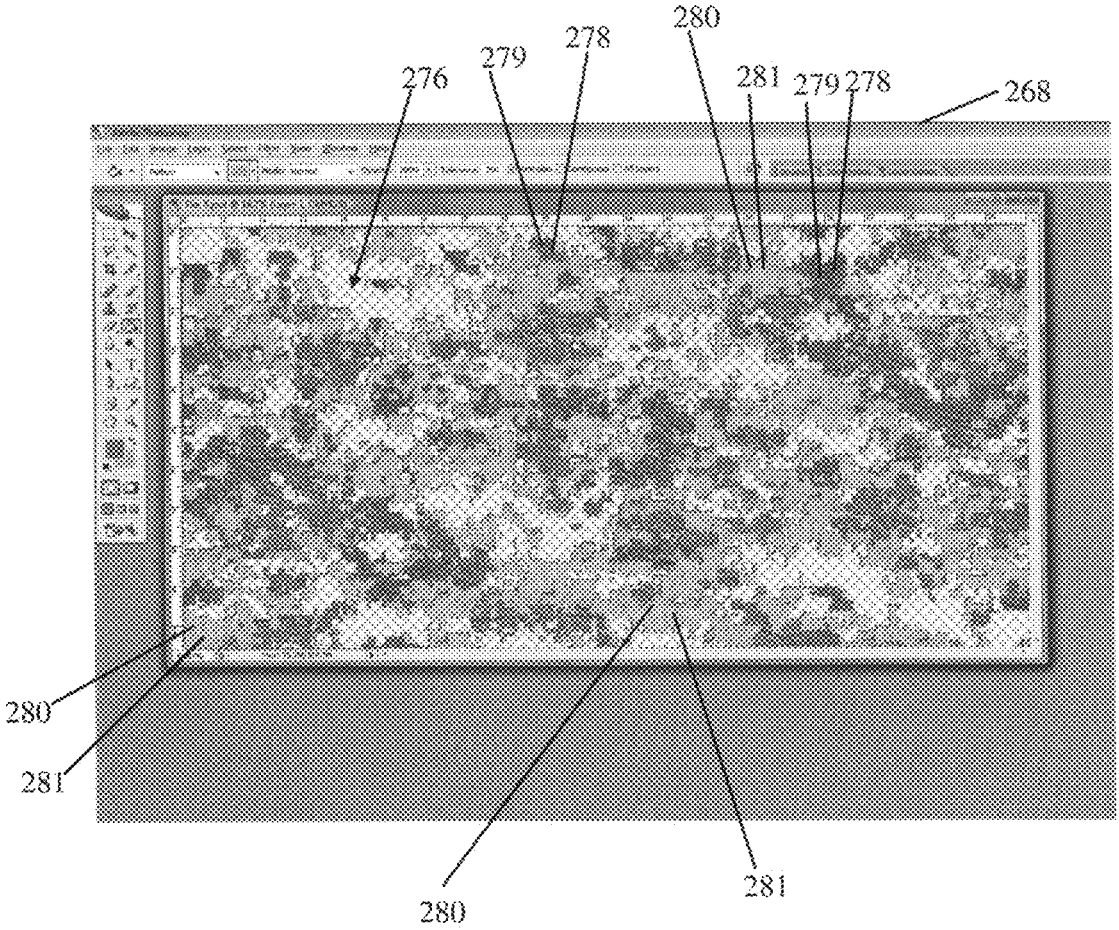

As shown in FIG. 21, a second disruptive pattern 280 can be generated or added to the gray scale 276. The disruptive pattern can be any shape. In the embodiment shown, the disruptive pattern 280 is a generally amorphous shape. This second disruptive pattern 280 resides in areas not occupied by the first disruptive pattern 278 containing the portions 279 of the image of the area 274. The second disruptive pattern 280 can receive portions of one of the remaining images of the areas 270, 272 from one of the respective digital photographic images 262, 264. As shown in FIG. 22, the image-editing program 268 can be used to drop in portions 281 of the image of the area 270 from the digital photographic images 262. In this manner, the image of the area 270 is applied to the second disruptive pattern.

Figure 23:
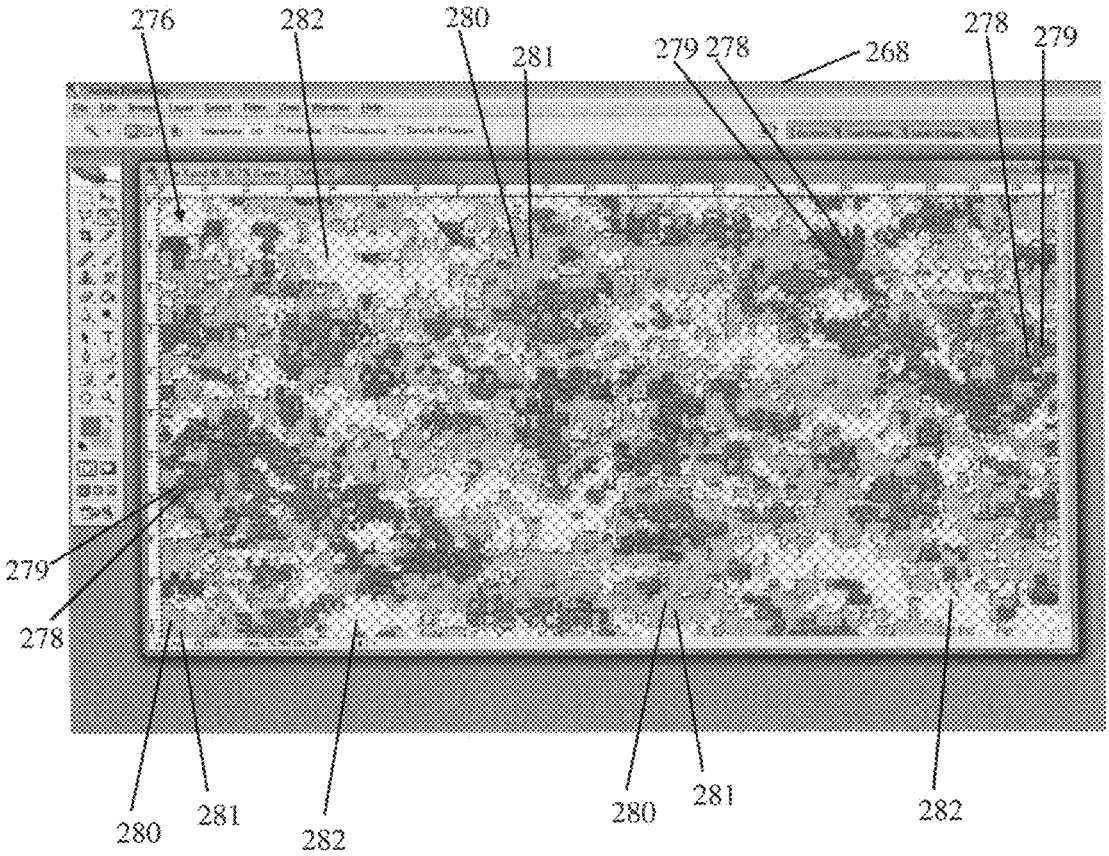

As shown in FIG. 23, a third disruptive pattern 282 can be generated or added to the gray scale 276. The disruptive pattern can be any shape. In the embodiment shown, the disruptive pattern 282, like the other disruptive patterns 278, 280, is a generally amorphous shape. This third disruptive pattern 282 resides in areas not occupied by the first and second disruptive patterns 278, 280 containing the portions 279, 280 of the image of the respective areas 274, 270. Since only three disruptive patterns are used in this example, the third disruptive pattern 282 resides in any area not occupied by the other two disruptive patterns 278, 280.

Figure 24:
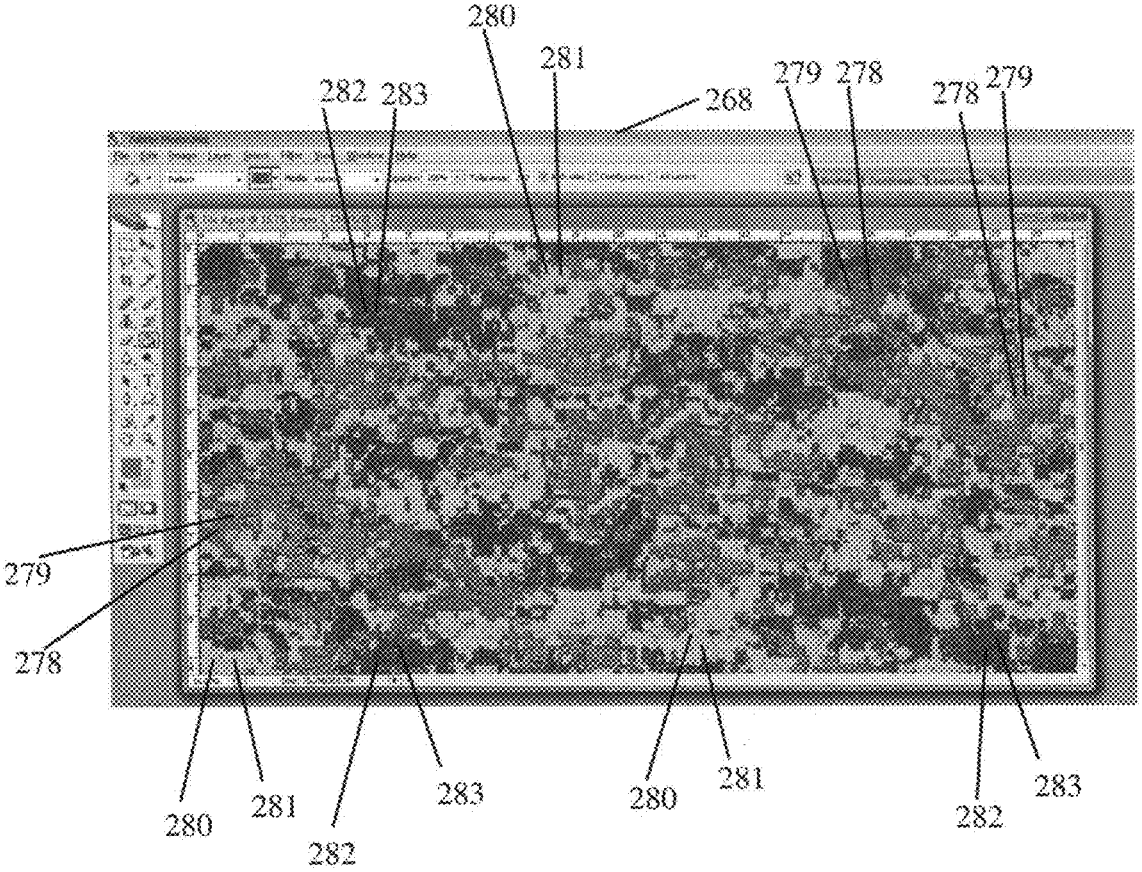

The third disruptive pattern 282 can receive portions of the remaining image of the area 272 from one of the respective digital photographic images 264 not used in the other disruptive patterns 278, 280. As shown in FIG. 24, the image-editing program 268 can be used to drop in portions 283 of the image of the area 272 from the digital photographic images 264. In this manner, the image of the area 272 is applied to the third disruptive pattern.

Figure 25:
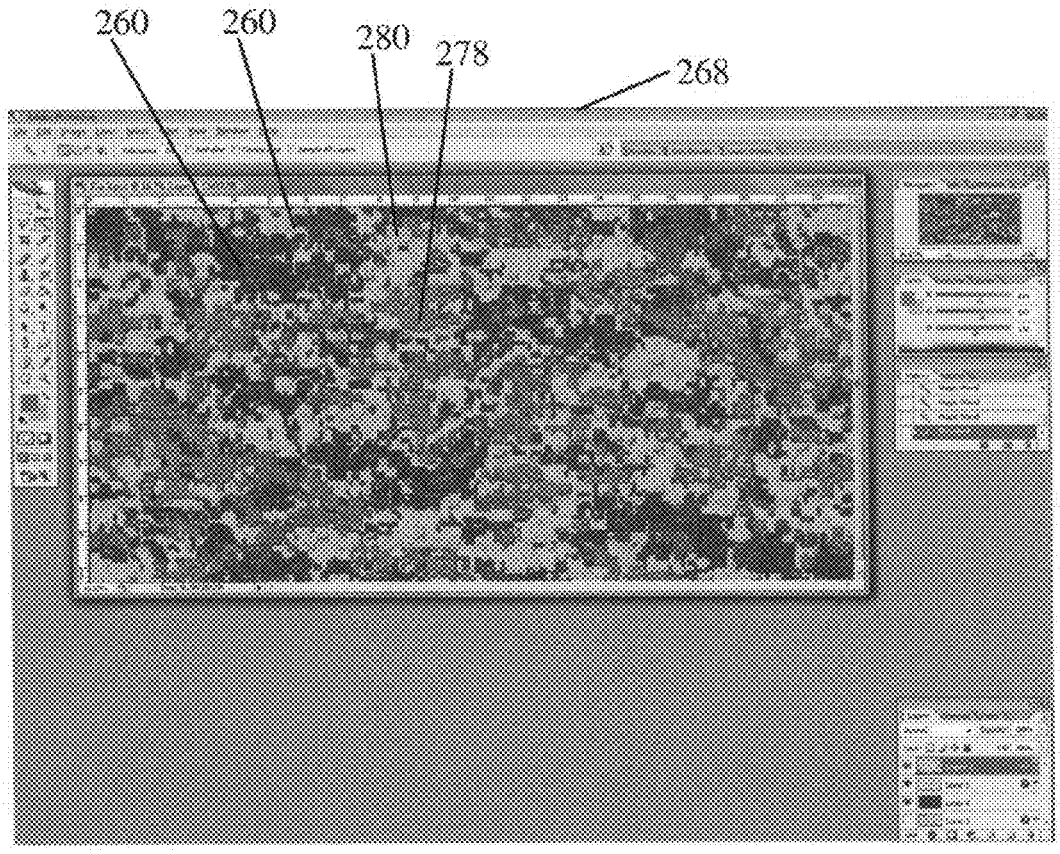
Figure 26:
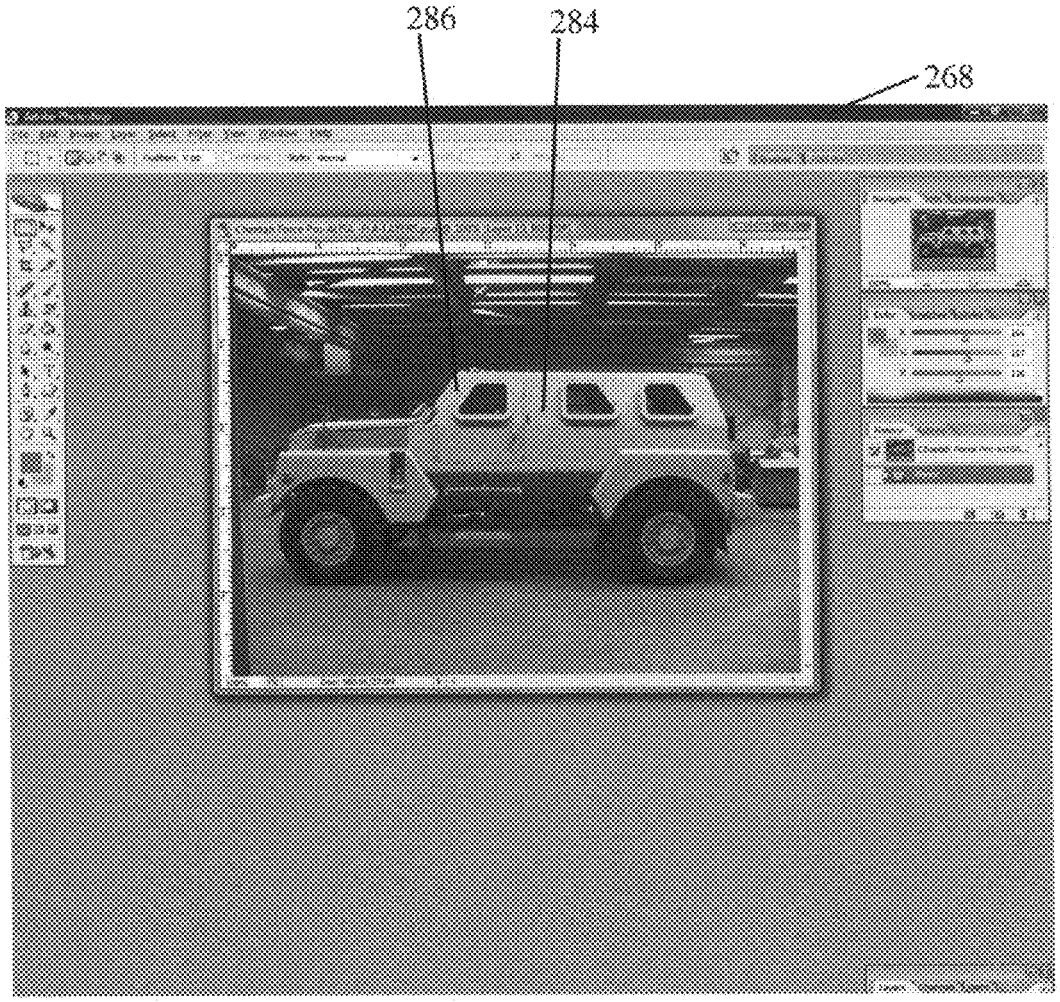
FIGS. 26-29 illustrate steps for an embodiment of a mock-up process for embodiments of a camouflage pattern or arrangement according to the present subject matter.

Once the last disruptive pattern has an image applied to it and any clean-up using the image-editing program 268 is conducted, a camouflage pattern 260 is created as shown in FIG. 25. The camouflage pattern 260 has three disruptive patterns 278, 280, 282 having different images of areas 270, 272, 274 from different site-specific photographic images 262, 264, 266 that have different focal lengths to create visual confusion for concealment and deception. One or more of the different focal lengths of such images can be improper focal lengths (not shown) that cause those images to appear out of focus. Generally, it should be understood that such camouflage patterns can include two or more disruptive patterns. For example, four or five patterns can be used in make such camouflage.

Digital copies of the created photographic camouflage pattern 260 can be saved at varying sizes for different size applications on the computer or a memory device, such as a compact disk, a floppy disk, a portable zip drive, a memory drive, or the like. A "proof" sample can be printed out at this stage to check and see if color, clarity, and depth are achieved.

Next, a mock-up can now be performed using the image-editing program 268 as shown in FIG. 26-29. Images of the particular physical item 284, such as a vehicle, can be opened in the image-editing program 268 on the computer. The images of physical item 284 are a digital, scaled down versions of the vehicle for which the camouflage pattern 260 can be designed. The images of physical item 284 can serve as an object template 286. This image can be a true to scale template. Therefore, when the camouflage 260 is taken to a direct application, the measurements remain correct when printed in actual size. As shown in FIG. 27, the object template 286 of the physical item 284 is "pathed" by adding lines such as lines 288, 290, 292 to the object template 286 to identify where the panels of camouflage 260 would be affixed onto the vehicle.

Figure 28:
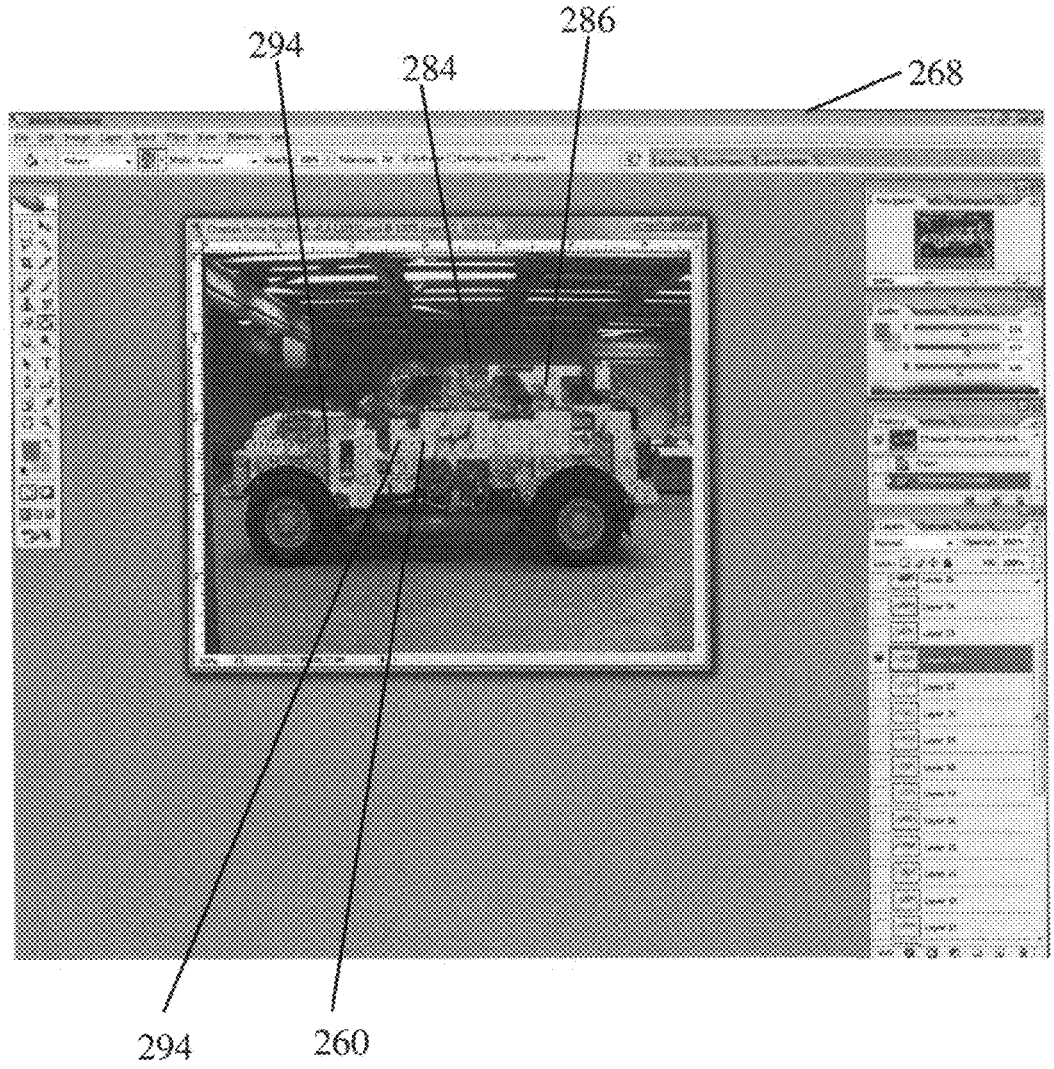

As shown in FIG. 28, the appropriate size of the previously saved photographic camouflage pattern 260 that best corresponds with the size of the template 286 of the physical item 284 to be camouflaged can be chosen. Using the image-editing program, the image or images of the camouflage 260 can then be divided into sections to create appropriately sized panels 294. The panels 294 can be applied to the object template 86 using the image-editing program 268.

Figure 29:
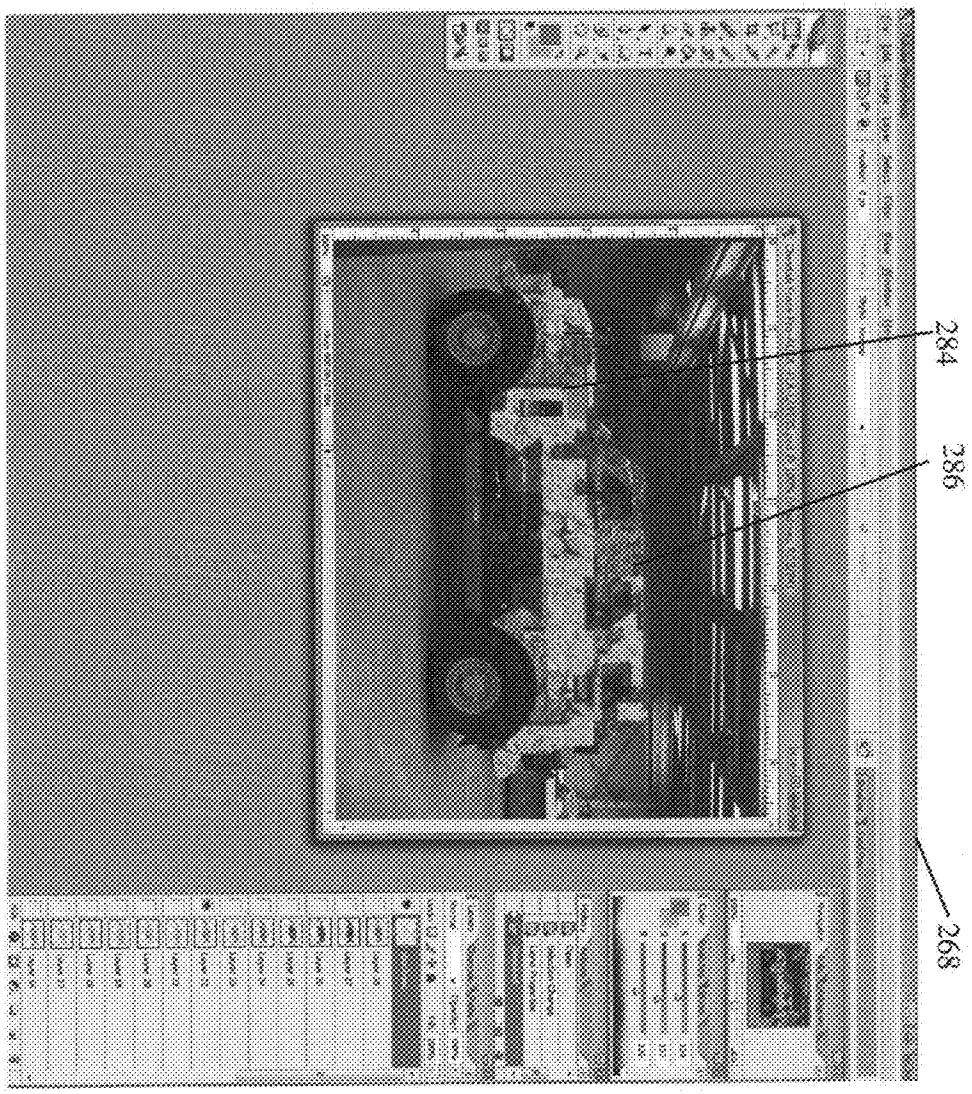

As shown in FIG. 29, appropriate shading based on the shadows created by the physical item 284 can be added to the template 286 using the image-editing program 268 to create a general likeness of the physical item 284 as it would appear upon being camouflaged with the created pattern to determine its viability. Again, this shading adds realism to test the effectiveness of the finished design without have to create a finished product. If the desired camouflage effect is achieved, further steps can be taken in creating a camouflage material which will be described in greater detail below.

Figure 30:
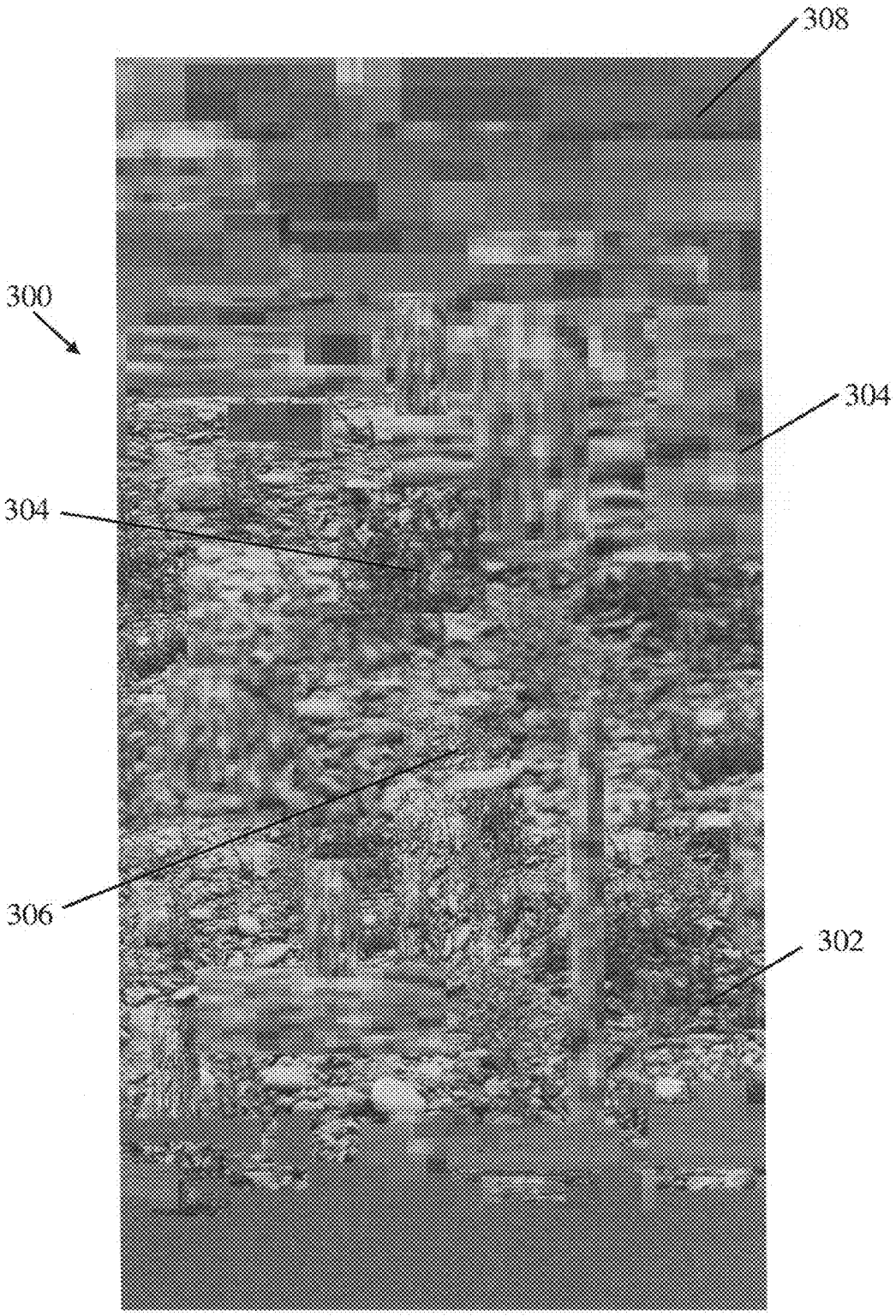
FIG. 30 illustrates a further embodiment of a camouflage pattern or arrangement according to the present subject matter.

In an embodiment shown in FIG. 30, a camouflage pattern 300 can be created by taking a base digital photographic image 302 and creating disruptive patterns 304, 306, 308 of distortions through the use of magnifications or demagnifications of portions of the digital photographic image 302. Such disruptive patterns 304, 306, 308 of distortions can make use of portion of image 302 having improper focal lengths to create disruptive patterns that are out of focus. The disruptive patterns 304, 306, 308 of distortions can be generated and layered over the base digital photographic image 302 using an image-editing program on a computer to achieve the desired disruptive effect in the camouflage 300 that aids in creating visual confusion by inhibiting normal depth perception.

As shown in FIG. 25, image 302 can have can have disruptive patterns 304, 306, 308 of different portions of the image 302 that have different focal lengths. For example, disruptive pattern 306 can have a longer focal length than the base image 302 with disruptive pattern 306 still being in focus. Disruptive pattern 304 can have an improper focal length that creates a blurred distortion that is somewhat out of focus. Further, disruptive pattern 308 can also have an improper focal length that creates a blurred distortion that is even more out of focus than the disruptive pattern 304. This use of photo-over-photo technique also achieves both a disruptive effect and makes the camouflage 300 have a visually confusing effect at different focal distances.

As described above, such disruptive patterns with blurred distortions can create further visual confusion for an observer and/or for an electronic and/or optical device. For example, an optical or electronic device that detects a physical item that contains images having multiple focal lengths and/or image portions having improper focal lengths that creates an out of focus portion will have difficulty focusing on the physical item and/or determining a correct distance between the device and the physical item. Such visual confusion aids in camouflaging and protecting the physical item.

Once the desired camouflage effect is confirmed as described above, a second proof can be printed at this stage to check and see if the appropriate color, clarity, and depth are still being achieved and the camouflage still is an ideal match for the operating environment. Next, using the image-editing program, the image of the camouflage can be divided into the panels as described hereinabove.

Some or all of these techniques and enhancements used in the camouflage embodiments described above can be used together or separately according to the desired effect or effects. The description provided below can be used with any of the camouflage embodiments described above, unless stated otherwise. The camouflage patterns, the methods of making the same and the different materials or substrates on which they can be used provide various ways to create visual confusion and deception for the physical items on which they are applied.

Embodiments of the present disclosure shown in the drawings and described above are exemplary of numerous embodiments that can be made within the scope of the appending claims. It is contemplated that the configurations of the site-specific visual camouflage systems and related methods can comprise numerous configurations other than those specifically disclosed. The scope of a patent issuing from this disclosure will be defined by these appending claims.

What is claimed is:

1. A site specific visual camouflage system that provides at least one of thermal or radar suppression, the system comprising:

a vinyl layer having a camouflage pattern on a front surface of the vinyl layer, the camouflage pattern comprising a site-specific camouflage pattern;

a laminate layer secured over the front surface of the vinyl layer coating the camouflage pattern to provide protection to the camouflage pattern and strengthen the vinyl layer; and one or more nanomaterials disposed on at least one of the vinyl layer, camouflage pattern, or the laminate layer to provide at least one of thermal or radar suppression.

2. The system according to claim 1, wherein the nanomaterial is disposed on the vinyl layer.

3. The system according to claim 2, wherein the nanomaterial is disposed onto a surface of the vinyl layer by a sputtering deposition.

4. The method according to claim 3, wherein the step of adding the one or more nanomaterials includes mixing the nanomaterial into the adhesive before application of the adhesive layer onto the vinyl layer.

5. The system according to claim 2, wherein the nanomaterial is mixed into a vinyl material used to create the vinyl layer before the vinyl layer is formed.

6. The system according to claim 2, wherein the nanomaterial is also disposed on the laminate layer.

7. The system according to claim 1, wherein the nanomaterial is disposed on the laminate layer.

8. The system according to claim 7, wherein the nanomaterial is placed onto a surface of the laminate layer by a sputtering deposition.

9. The system according to claim 7, wherein the nanomaterial is mixed into a laminate material used to create the laminate layer before the laminate layer is formed.

10. The system according to claim 1, wherein the one or more nanomaterials comprises a first nanomaterial and a second nanomaterial.

11. The system according to claim 10, wherein the first nanomaterial is disposed on the vinyl layer.

12. The system according to claim 11, wherein the second nanomaterial is disposed on laminate layer.

13. The system according to claim 10, wherein both the first and second nanomaterials are disposed on the vinyl layer.

14. The system according to claim 10, wherein the first and second nanomaterials are on laminate layer.

15. The system according to claim 10, wherein the first nanomaterial comprises microspheres and the second nanomaterial comprises an aerogel in powder form.

16. The system according to claim 10, wherein the first nanomaterial comprises an aerogel in powder form and the second nanomaterial comprises microspheres.

17. The system according to claim 10, wherein the camouflage pattern comprises ink and the second nanomaterial is mixed into the ink before printing of the camouflage pattern onto the vinyl layer.

18. The system according to claim 10, further comprising an adhesive layer disposed on a surface of the vinyl layer opposite the surface on which the camouflage pattern is disposed and the second nanomaterial is mixed into the adhesive before application of the adhesive layer onto the vinyl layer.

19. The system according to claim 10, further comprising a second laminate layer disposed on a surface of the first laminate layer opposite the surface on which the camouflage pattern and the vinyl layer are disposed and at least one of the first nanomaterial or the second nanomaterial being disposed on the second laminate layer.

20. The system according to claim 19, wherein the second nanomaterial is disposed on the second laminate layer and on the vinyl layer and the first nanomaterial is disposed on the first laminate layer and on the vinyl layer.

21. The system according to claim 19, wherein the first nanomaterial is disposed on the second laminate layer and the second nanomaterial is disposed on the first laminate layer and on the vinyl layer.

22. The system according to claim 1, wherein the camouflage pattern comprises ink and the nanomaterial is mixed into the ink before printing of the camouflage pattern onto the vinyl layer.

23. The system according to claim 1, further comprising an adhesive layer disposed on a surface of the vinyl layer opposite the surface on which the camouflage pattern is disposed and the nanomaterial is mixed into the adhesive before application of the adhesive layer onto the vinyl layer.

24. The system according to claim 1, wherein the camouflage pattern comprises a site-specific digital photographic image printed on the vinyl layer.

25. The system according to claim 1 wherein the camouflage pattern comprises:

a photographic image; and a disruptive pattern of at least one color configured on the photographic image, the at least one color being selected from a range of colors from at least one of the photographic image or an operating environment in which the camouflage is intended to be used.

26. The system according to claim 25, wherein the camouflage pattern further comprises additional micropatterns configured on the photographic image, the micropatterns being smaller than the disruptive patterns.

27. The system according to claim 26, wherein the micropatterns include one or more additional colors selected from the range of colors, the one or more additional colors including colors not used in the disruptive pattern.

28. The system according to claim 26, wherein the camouflage pattern further comprises one or more additional disruptive patterns configured on the photographic image, the one or more additional disruptive patterns including one or more additional colors not used in the disruptive pattern and selected from the range of colors.

29. The system according to claim 1 wherein the camouflage pattern comprises:

a base photographic image; and one or more distorting disruptive patterns including images having different focal lengths configured on the base photographic image.

30. The system according to claim 29, wherein the base photographic image comprises a site-specific photographic image.

31. The system according to claim 29, wherein images having different focal lengths comprise one or more site-specific photographic images or portions of one or more site-specific photographic images.

32. The system according to claim 29, wherein the images having different focal lengths comprise portions of one or more different photographic images than the base photographic image.

33. The system according to claim 29, wherein the images having different focal lengths comprise portions of the base photographic image.

34. The system according to claim 29, wherein the different focal lengths include improper focal lengths that make the image appear to be out of focus.

35. The system according to claim 29, further comprising one or more additional disruptive patterns of at least one color from a range of colors from at least one of the base digital photographic image or an operating environment in which the camouflage is intended to be used.

36. The system according to claim 35, wherein the camouflage pattern further comprises additional micropatterns configured on the digital photographic image, the micropatterns being smaller than the disruptive patterns.

37. The system according to claim 36, wherein the micropatterns include one or more additional colors selected from the range of colors, the one or more additional colors including colors not used in the disruptive pattern.

38. A visual camouflage system providing at least one of thermal or radar suppression, the system comprising:

a vinyl layer having a camouflage pattern on a front surface of the vinyl layer, the camouflage pattern comprising a site-specific camouflage pattern;

a laminate layer secured over the front of the vinyl layer coating the camouflage pattern to provide protection to the camouflage pattern and strengthen the vinyl layer;

a pulverized aerogel disposed on at least one of the vinyl layer, the camouflage pattern, or the laminate layer to provide thermal suppression; and microspheres disposed on at least one of the vinyl layer, camouflage pattern, or the laminate to provide radar suppression.

39. A method of making a site-specific visual camouflage system that provides at least one of thermal or radar suppression, the method comprising:

providing a vinyl layer;

printing a camouflage pattern on a front surface of the vinyl layer, the camouflage pattern comprising a site-specific camouflage pattern;

securing a laminate layer over the front surface of the vinyl layer, the laminate coating the camouflage pattern to provide protection to the camouflage pattern and strengthen the vinyl layer; and adding one or more nanomaterials on at least one of the vinyl layer, camouflage pattern, or the laminate to provide at least one of thermal or radar suppression.

40. The method according to claim 39, wherein the one or more nanomaterials comprise at least one of an aerogel in powder form or microspheres.

41. The method according to claim 40, wherein the step of adding the one or more nanomaterials includes sputtering the nanomaterial onto a surface of the vinyl layer.

42. The method according to claim 40, wherein the step of adding the one or more nanomaterials includes sputtering the nanomaterial onto a surface of the laminate layer.

43. The method according to claim 40, wherein the step of adding the one or more nanomaterials includes mixing the nanomaterial into a vinyl material used to create the vinyl layer before formation of the vinyl layer.

44. The method according to claim 40, wherein the step of adding the one or more nanomaterials includes mixing the nanomaterial into a laminate material used to create the laminate layer before formation of the laminate layer.

45. The method according to claim 40, wherein ink is used to print the camouflage pattern and the step of adding the one or more nanomaterials includes mixing the nanomaterial into the ink before printing of the camouflage pattern onto the vinyl layer.

46. The method according to claim 40, further comprising applying an adhesive layer to a surface of the vinyl layer opposite the front surface of the vinyl layer.

* * * * *